US008686352B2

(12) United States Patent
Kawaguchi et al.

(10) Patent No.: US 8,686,352 B2
(45) Date of Patent: Apr. 1, 2014

(54) SYSTEMS AND COMPUTER PROGRAM PRODUCTS FOR MASS SPECTROMETRY

(75) Inventors: Yohei Kawaguchi, Hachioji (JP); Yuichiro Hashimoto, Tachikawa (JP); Masuyuki Sugiyama, Hino (JP); Shun Kumano, Kokubunji (JP); Shuhei Hashiba, Wako (JP); Masahito Togami, Higashiyamato (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 13/468,967

(22) Filed: May 10, 2012

(65) Prior Publication Data

US 2012/0298852 A1 Nov. 29, 2012

(30) Foreign Application Priority Data

May 23, 2011 (JP) ..... 2011-115189

(51) Int. Cl.
*H01J 49/26* (2006.01)

(52) U.S. Cl.
USPC ..... 250/287; 250/281; 250/282; 702/22; 702/27; 702/28

(58) Field of Classification Search
USPC ..... 250/281, 282, 286, 287; 702/22, 27, 28
See application file for complete search history.

(56) References Cited

U.S. PATENT DOCUMENTS

2011/0270566 A1* 11/2011 Sawada et al. ..... 702/108

FOREIGN PATENT DOCUMENTS

JP 2008-170260 A 7/2008

* cited by examiner

*Primary Examiner* — Nicole Ippolito
(74) *Attorney, Agent, or Firm* — Miles & Stockbridge P.C.

(57) ABSTRACT

A mass spectrometry system is mounted with (1) an action planning module for determining a measurement schedule provided by a combination of an MS analysis and an MS$^n$ analysis (where n≥2) according to a measuring time provided previously; and (2) a mass spectrometry unit having a tandem mass spectrometry function for outputting a mass spectrum obtained by performing each measurement action constructing the measurement schedule.

20 Claims, 17 Drawing Sheets

FIG. 4

| NUMBER k | MEASUREMENT ACTION j (FIGURES IN PARENTHESES DESIGNATE m/z OF PRECURSOR ION) | LIST OF MATERIAL CONTAINED IN TARGET SAMPLE AT THE TIME OF MEASUREMENT (MATERIAL, CONCENTRATION) | m/z NUMBER i = 1 INTENSITY | ... | m/z NUMBER i = S INTENSITY |
|---|---|---|---|---|---|
| 1 | $MS^1$ | (c_1, 0.1 ppm), (c_2, 0.1 ppm) | 0.01 | ... | 0.01 |
| 2 | $MS^2$(m_1) | (c_1, 1 ppm), (c_4, 0.1 ppm), (c_M, 0.5 ppm) | 0.01 | ... | 0 |
| 3 | $MS^1$ | (c_2, 0.1 ppm) | 0 | ... | 0.01 |
| | | | | ... | |
| L | $MS^2$(m_N) | (c_M, 0.5 ppm) | 0.01 | ... | 0 |
| 301 | 302 | 303 | 304(1) | | 304(S) |

FIG. 6

| ROW: MEASUREMENT ACTION j<br>COLUMN: MATERIAL | c_1 | c_2 | ... | c_M |
|---|---|---|---|---|
| $MS^1$ | 0.3 | 0.3 | ... | 0.3 |
| $MS^2(m_1)$ | 0.4 | 0 | ... | 0 |
| $MS^2(m_2)$ | 0 | 0.5 | ... | 0 |
| | | | | |
| $MS^2(m_N)$ | 0 | 0 | ... | 0.8 |

FIG. 8

| MEASUREMENT ACTION j | TIME T(j) |
|---|---|
| $MS^1$ | 100 msec |
| $MS^2$ (m_1) | 400 msec |
| $MS^2$ (m_2) | 400 msec |
| | |
| $MS^2$ (m_N) | 400 msec |

EMBODIMENT

EMBODIMENT

SYSTEMS AND COMPUTER PROGRAM PRODUCTS FOR MASS SPECTROMETRY

The present application claims priority from Japanese patent application JP 2011-115189 filed on May 23, 2011, the content of which is hereby incorporated by reference into this application.

FIELD OF THE INVENTION

The present invention relates to a mass spectrometry system including a mass spectrometry unit having a tandem mass spectrometry function and a computer program for controlling a measurement action of the system.

BACKGROUND OF THE INVENTION

An analysis method using a mass spectrometry unit having a tandem mass spectrometry function can be divided broadly into two methods.

One method is a method for measuring quantities of all ionized materials for each mass-to-charge ratio (m/z) of the materials. This method is referred to as an MS (or $MS^1$) analysis.

Another method is a method of selecting only ions each having a specific mass-to-charge ratio m/z (referred to as "precursor ion") from among all ionized materials to separate the precursor ions from among the other ions (this process is referred to as "isolation"), further dissociating the precursor ions to produce ions (referred to as "product ion"), and then measuring the quantity of the product ions for each m/z. This method is referred to as an $MS^n$ analysis. The $MS^n$ analysis is referred to as an $MS^2$ analysis (one time of dissociation), an $MS^3$ analysis (two times of dissociation), . . . , and an $MS^n$ analysis ((n−1) times of dissociation) according to the number of times of repetition of the selection, the isolation, and the dissociation of the precursor ion.

In general, depending on an object to be measured, the ions of different materials can appear at the same m/z. For this reason, such materials cannot be differentiated from each other only by the MS analysis. In contrast to this, the $MS^n$ analysis reveals at what level of m/z the product ion appears, so that the $MS^n$ analysis can differentiate the materials of the objects to be measured from each other in more detail. In this way, the amount of information obtained by the $MS^n$ analysis is generally larger than the amount of information obtained by the MS analysis.

Here, the amount of information means the amount of information by which the presence or absence of a material of an object to be measured can be detected, the amount of information by which the kind of the material can be identified, or the amount of information by which the material can be quantified for each kind. In the case were an object to be measured contains a large amount of impurities or in the case where the amount of a material to be measured is very little, the amount of information obtained by the $MS^n$ analysis is larger than the amount of information obtained by the MS analysis.

However, a time required for the $MS^n$ analysis is longer than a time required for the MS analysis by the processes of isolation and dissociation. In addition, the amount of consumption of a target sample increases according to a time required for the mass spectrometry. For this reason, when a time required for the measurement is long, a material of an object to be measured is likely to be consumed during the measurement and hence information is likely to be not obtained thereafter. Thus, the measurement of the target sample needs to be efficiently performed within a limited time. In particular, an object material having a high ionization efficiency is consumed quickly. Therefore, the time required for the measurement of such an object material needs to be a short time. In this way, a trade-off relationship is recognized between the amount of information to be obtained and the time required for the measurement.

Hence, in the actual measurement, the MS analysis is combined with the $MS^n$ analysis to balance the amount of information and the time required for the measurement. For example, in Japanese Unexamined Patent Publication No. 2008-170260 is described a tandem mass spectrometry system in which, of a mass spectrum obtained by the MS analysis, only ions having a mass-to-charge ratio m/z whose peak intensity is equal to or larger than a given threshold is selected as precursor ions for the $MS^2$ analysis to limit the number of times of performance of the $MS^2$ analysis.

In this system, a series of procedures of performing the MS analysis once and then performing the $MS^2$ analysis by the times of the number of the selected precursor ions are repeatedly performed. A database is searched for a mass spectrum obtained by the $MS^2$ analysis for the m/z of the precursor ion of each time to thereby identify the kind of the material of each ion. In this way, the system described in Japanese Unexamined Patent Publication No. 2008-170260 restricts the number of times of performance of the $MS^2$ analysis to thereby shorten the time required for the measurement. In this regard, when the precursor ion is selected in each time of the $MS^2$ analysis, only m/z that is not identified by the last repetition of the series of procedures is selected (that is, the $MS^2$ analysis is not again performed for the m/z once identified) to thereby further decrease the time required for the measurement. The system described in Japanese Unexamined Patent Publication No. 2008-170260 realizes an efficient analysis of a target sample by the method described above.

SUMMARY OF THE INVENTION

However, the method in the related art presents the problems described below.

(1) In the case where the length of time in which the measurement can be performed (hereinafter referred to as "measuring time") is limited to a short length of time, within the short length of time, the measurement needs to be finished, the detection of the presence or absence of a material needs to be finished, the identification of the kind of the material needs to be finished, or the quantification of the material needs to be finished for each kind.

(2) In the case where the measurement can be performed in a long length of time, according to the length of time, the accuracy of detection of the presence or absence of the material needs to be improved, the accuracy of identification of the kind of the material needs to be improved, or the accuracy of quantification of the material needs to be improved for each kind.

In this regard, also in the case of the method in the related art, when a function of stopping performing the measurement in the measuring time is introduced into the method in the related art, the method in the related art can respond to the problem (1) in a sort. However, even if the measuring time is satisfied, the measurement is likely to be finished before the $MS^2$ analysis is performed for all object materials, which raises the possibility that the detection of the presence or absence of the material, the identification of the kind of the material, or the quantification of the material for each kind will be not finished for a part of the object materials.

Further, in the method in the related art, even if the measuring time is sufficient, the $MS^2$ analysis is not performed for the identified material. For this reason, the problem (2) cannot be solved.

Hence, the object of the present invention is to finish detecting the presence or absence of a material, identifying the kind of the material, or quantifying the material for each kind within a measuring time even if the measuring time is limited and to realize an improvement in the accuracy of the respective analyses according to a given length of the measuring time.

Therefore, as a mass spectrometry system according to an aspect of the present invention is proposed a mass spectrometry system including: (1) an action planning module for determining a measurement schedule provided by a combination of an MS analysis and an $MS^n$ analysis (where $n \geq 2$) according to a measuring time provided previously; and (2) a mass spectrometry unit having a tandem mass spectrometry function for outputting a mass spectrum obtained by performing each measurement action constructing the measurement schedule.

The present invention determines a measurement schedule according to a measuring time. For this reason, in the case where the measuring time is limited to a short length of time, the action planning module determines the measurement schedule in such a way that while a frequency of the MS analysis is increased, a frequency of the $MS^n$ analysis (where $n \geq 2$) is decreased. In this way, even in the case where the measuring time is limited, the action planning module can perform the detection of the presence or absence of a material, the identification of the material, or the quantification of the material for all object materials. Further, in the case where the measuring time is set to a sufficiently long length of time, the action planning module determines the measurement schedule in such a way that while the frequency of the MS analysis is decreased, the frequency of the $MS^n$ analysis (where $n \geq 2$) is increased. As a result, in the case where the measuring time has leeway, an accuracy of detection of the presence or absence of a material, an accuracy of identification of the material, or an accuracy of quantification of the material for each kind can be improved.

Problems, constructions, advantages other than those described above will be made clear by the descriptions of the embodiments described below.

BRIEF DESCRIPTION OF THE DRAWINGS

FIG. 4 is a view to show an example of a data structure of a mass spectrum database;

FIG. 6 is a view to show an example of a data structure of a prior priority by measurement database;

FIG. 8 is a view to show an example of a data structure of a required time by measurement database;

DETAILED DESCRIPTION OF THE PREFERRED EMBODIMENTS

Hereinafter, embodiments of the present invention will be described with reference to the drawings. Here, the embodiment of the present invention is not limited to the exemplary embodiments described below but can be variously modified within the scope of its technical thought. In this regard, the present invention can be applied not only to an explosive-detection system, a soil analysis system, a water quality analysis system, a drug-detection system, and an indoor environment measurement system, but also to a system for detecting the presence or absence of a material, a system for identifying the kind of a material, or a system for quantifying a material.

First Embodiment

System Construction 1

Figure 1:
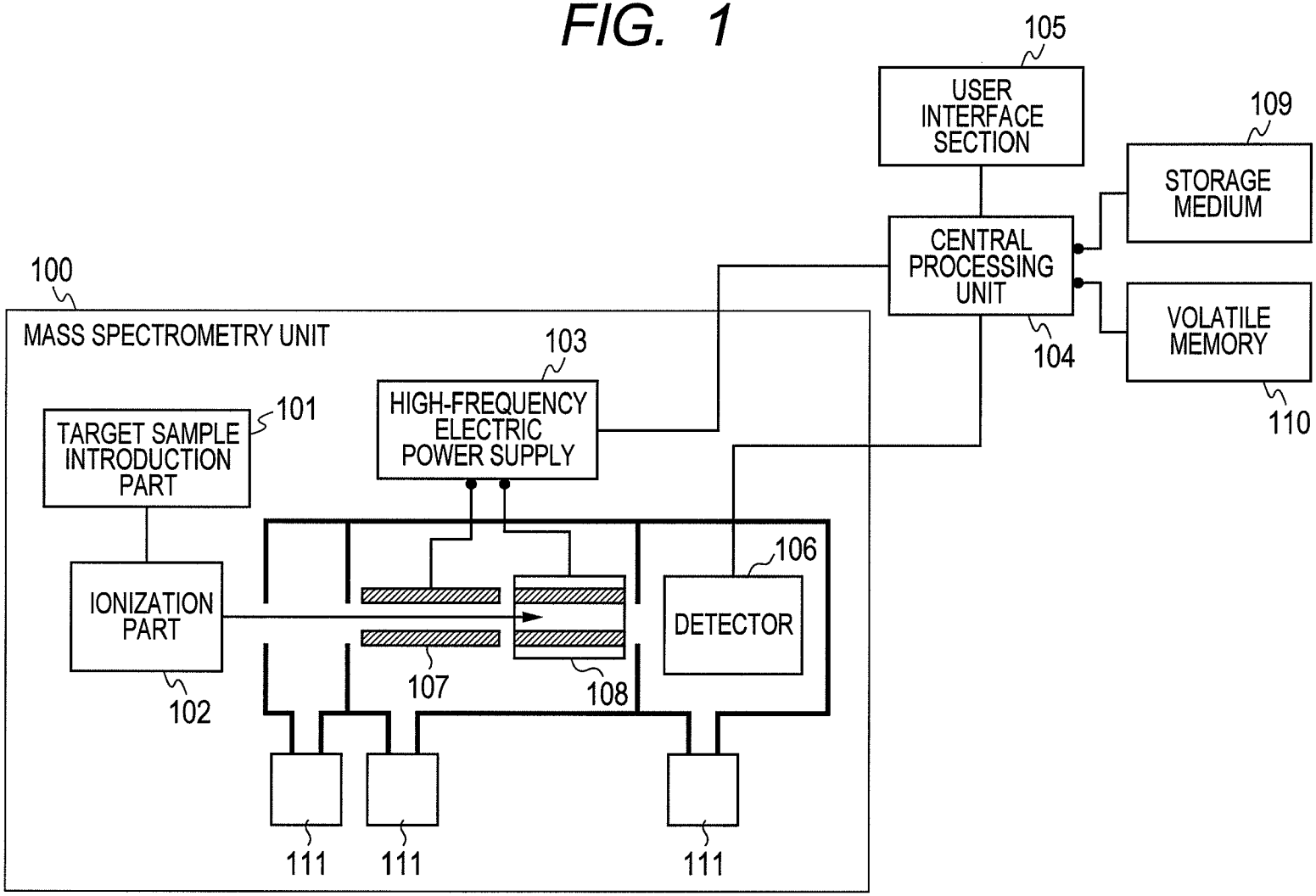
FIG. 1 is a view to show a hardware construction of a mass spectrometry system according to an embodiment.

FIG. 1 shows a hardware construction of amass spectrometry system according to an exemplary embodiment. The mass spectrometry system is constructed of a mass spectrometry unit 100, a central processing unit 104, a user interface section 105, a storage medium 109, and a volatile memory 110. Here, the mass spectrometry unit 100 is constructed of a target sample introduction part 101, an ionization part 102, a high-frequency power supply 103, detector 106, an ion transportation part 107, an ion trap 108, and pumps 111.

The target sample introduction part 101 introduces a target sample into the ionization part 102 in the state of vapor, misty liquid droplets, or fine particles. The introduced target sample is ionized by the ionization part 102 having an ion source. An electro-spray ionization method, a sonic spray ionization method, or the other ionization technique can be used for ionization.

The generated ion is transported from the ionization part 102 to the ion trap 108 via the ion transportation part 107. A quadruple ion trap, a linear trap, or the like is used for the ion trap 108. The high-frequency power supply 103 supplies a high-frequency voltage to the ion trap 108. The supplied ion is trapped in the ion trap 108. By temporally varying the high-frequency voltage applied to the ion trap 108, the trapped ion is transported to the detector 106 at a different time for each m/z. The amount of ions reaching the detector 106 is converted into a voltage value and is sent to the central processing unit 104.

Figure 2:
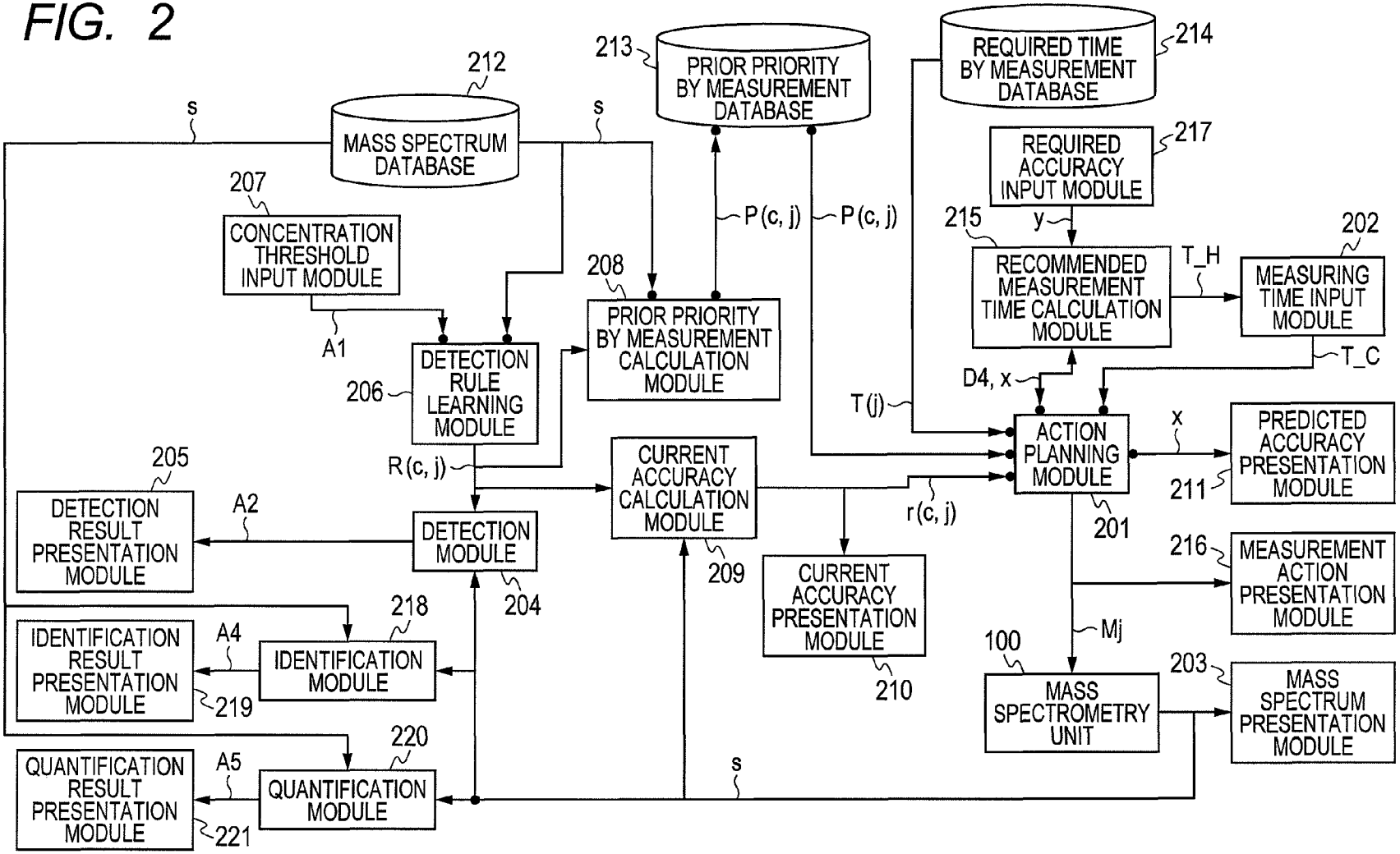
FIG. 2 is a view to show a function block diagram of the mass spectrometry system according to the embodiment.

The central processing unit 104 converts each time of a voltage signal appearing in time sequence into m/z of the ion to thereby replace the voltage signal with data (referred to as "mass spectrum") representing the amount of ion corresponding to each m/z and stores the data (mass spectrum) in the volatile memory 110. The central processing unit 104 detects the presence or absence of an object material on the basis of the mass spectrum stored in the volatile memory 110. This processing is performed on the basis of the data of the mass spectrum obtained in the past and a detection rule calculated previously on the basis of these data. Further, the storage medium 109 stores the data of a prior priority by measurement database 213 (FIG. 2) and the data of a required time by measurement database 214 (FIG. 2). A detection result is presented to a user through a detection result presentation module 205 (FIG. 2) included by the user interface section 105. The central processing unit 104 acts as "an action planning module" claimed in claims.

The user interface section 105 is constructed of, for example, a touch panel display capable of inputting information and presenting information. The user interface section 105 includes a measuring time input module 202 (FIG. 2), a presence/absence threshold input module, a current accuracy presentation module 210 (FIG. 2), a predicted accuracy presentation module 211 (FIG. 2), a recommended measurement time presentation module, and a measurement action presentation module 216 (FIG. 2). Here, the user interface section 105 may be realized through software executed by a computer externally connected thereto via a network.

System Construction 2

Figure 14:
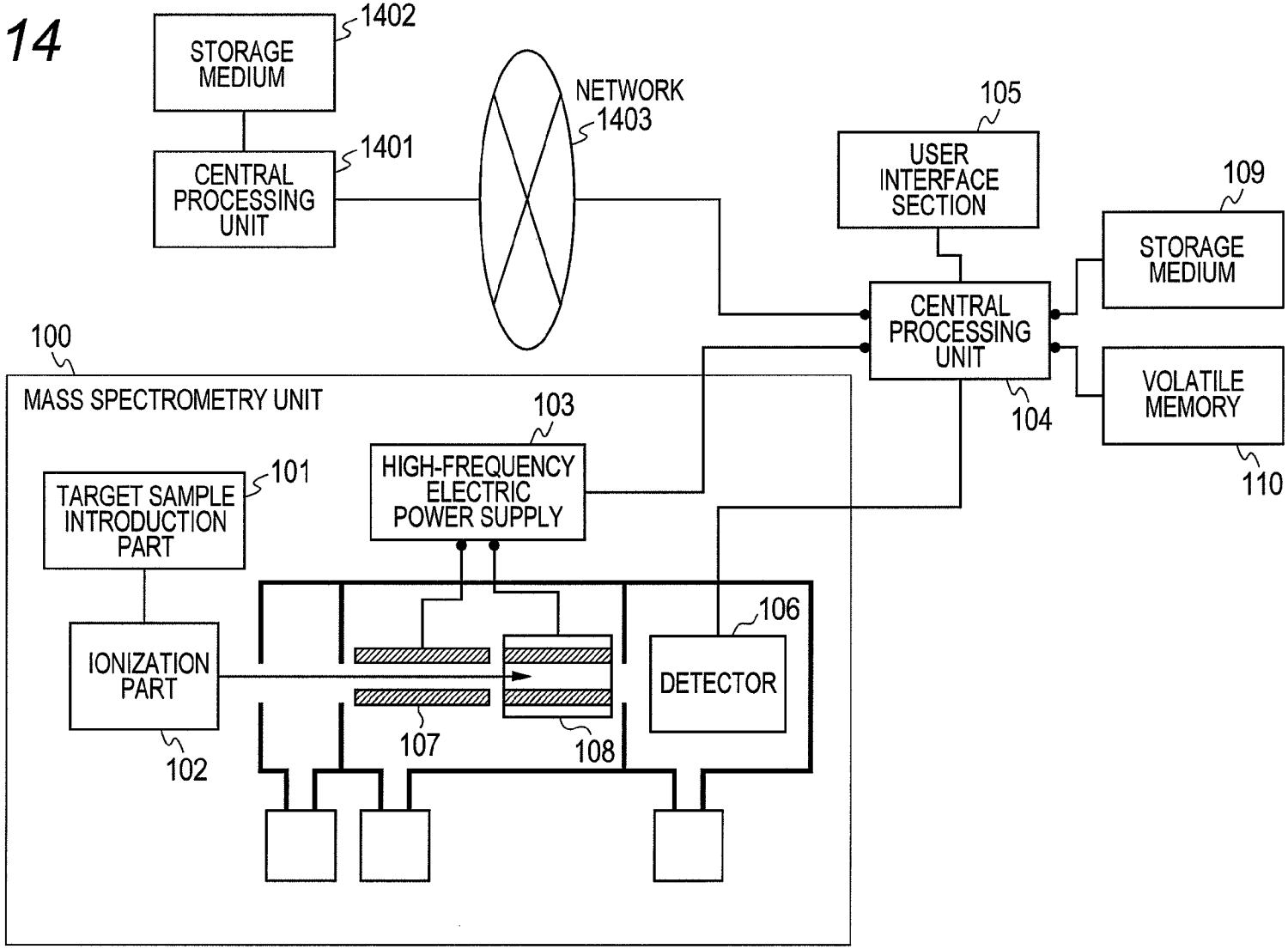
FIG. 14 is a view to show a hardware construction of a mass spectrometry system connected to an external computer via a network.

In addition, a system according to an exemplary embodiment, as shown in FIG. 14, may have a construction additionally including a central processing unit 1401 and a storage medium 1402 that are externally connected thereto through a network 1403. In this case, it is recommended that the storage medium 1402 stores the data of a mass spectrum s' obtained in the past, the data of a detection rule R(c, j) calculated previously on the basis of the data of the mass spectrum s', the data of the prior priority by measurement database 213 (FIG. 2), and the data of the required time by measurement database (FIG. 2). This can reduce the capacity of the storage medium 109. Further, it is recommended that the central processing unit 1401 be used for the calculation of the detection rule R(c, j) and for the calculation of a prior priority by measurement P(c, j), which will be described later. In this way, the processing performance of the central processing unit 1401 can be reduced.

[Function Construction of Central Processing Unit]

FIG. 2 shows a function block construction realized through a computer program executed on the central processing unit 104.

[Concentration Threshold Input Module 207]

A concentration (concentration threshold) A1 that is a threshold of detection is inputted through a concentration threshold input module 207. The concentration threshold input module 207 corresponds to the user interface section 105. In the case of a system construction in which the concentration threshold input module 207 does not exist, a suitable default value that is previously set is inputted as the concentration threshold A1.

[Detection Rule Learning Module 206]

A detection rule learning module 206 learns a detection rule on the basis of the concentration threshold A1 and the mass spectrum s' of a mass spectrum database 212 that is, previously obtained.

FIG. 4 shows an example of a data structure of the mass spectrum database 212. In the case of this exemplary embodiment, M kinds of materials c_1 to c_M are assumed to be an object to be measured. Candidates for measurement action include a MS and N (m_1 to m_N) $MS^2$ analyses for the m/z of a precursor ion, that is, measurement actions of a total sum of (N+1). These (N+1) measurement actions are assumed to be a measurement action set COM. It goes without saying that the measurement action set COM may include not only the MS analysis and the $MS^2$ analysis but also more general $MS^n$ analysis (n>2).

In the case of FIG. 4, the mass spectrum database 212 stores the sets of mass spectrum s' corresponding to L measurements. In each record 301 (number 1 to L) stores any one of the (N+1) measurement actions 302, a list 303 of materials contained in a target sample at the time of measurement, which shows the concentrations of M kinds of materials, and intensities 304(1) to 304(S) which correspond to the number of m/z (i=1 to S) which are properly discretized.

Figure 3:
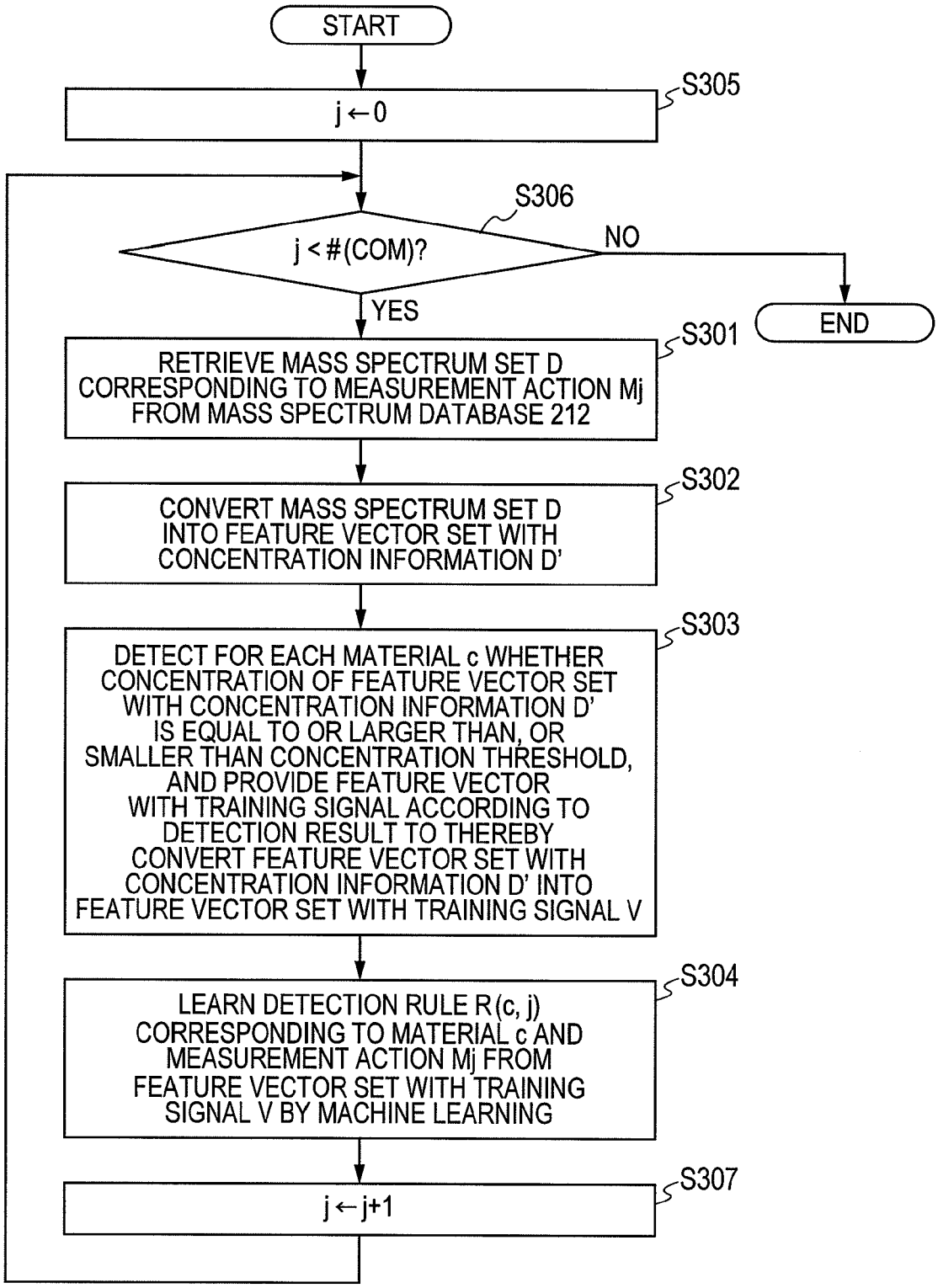
FIG. 3 is a flow chart to show a processing procedure performed by a detection rule learning module.

FIG. 3 shows an example of a processing procedure performed by the detection rule learning module 206. In step S305, a number j of a measurement action is initialized to 0. Thereafter, a learning processing is performed for each measurement action Mj.

In step S306, the detection rule learning module 206 detects whether or not the number j is equal to or smaller than the number of the measurement action set COM. If the number j is equal to or smaller than the number of the measurement action set COM, the detection rule learning module 206 performs the processings of step S301 and subsequent steps. On the other hand, if the number j is larger than the number of the measurement action set COM, the detection rule learning module 206 ends the learning processing.

In step S301, the detection rule learning module 206 retrieves a mass spectrum set D corresponding to the measurement action Mj from the mass spectrum database 212.

In step S302, the detection rule learning module 206 converts the mass spectrum set D into a feature vector set with concentration information D'. A method for converting amass spectrum s' into a feature vector may be, for example, a method for converting S intensities of the mass spectrum into a S-dimensional vector as they are, a method for converting S intensities of the mass spectrum into an M-dimensional vector in which M intensities of m/z numbers i(c_1) to i(c_M) corresponding to materials c_1 to c_M of objects to be measured are elements, or in the case where a reference material cˆSTD is also introduced at the same time when the measurement is performed, a method for converting S intensities of the mass spectrum into an (M+1)-dimensional vector in which also the intensity of the m/z number i(cˆSTD) corresponding to the reference material cˆSTD is included as an element, or a method for converting S intensities of the mass spectrum into an (M+K)-dimensional vector in which also the intensities of the m/z numbers i(cˆCNT_1) to i(cˆCNT_K) corresponding to K contaminants cˆCNT_1 to cˆCNT_K are included as elements.

Further, the method for converting a mass spectrum s' into a feature vector may be a method for converting S intensities of a mass spectrum into an (F+1)×(M+K)-dimensional vector having an F×(M+K)-dimensional vector added thereto, the F×(M+K)-dimensional vector including also intensities of peak m/z numbers i(c_1, 2, 1) to i(c_1, 2, F), . . . , i(c_M, 2, 1) to i(c_M, 2, F), i(cˆCNT_1, 2, 1) to i(cˆCNT_1, 2, F), . . . , i(c^CNT_K, 2, 1) to i(c_CNT_K, 2, F) of fragments of F materials obtained by the $MS^2$ analyses for the precursor ions of the respective materials i(c_1) to i(c_M) and i(c^CNT_1) to i(c^CNT_K).

Still further, the method for converting amass spectrum s' into a feature vector may be a method for converting a vector converted by any one of these methods into a vector reduced in dimension by any one of a principal component analysis, a discriminant analysis, an independent component analysis, and a non-negative matrix factorization.

This feature vector set D' itself may be stored in the mass spectrum database 212. In this case, there is provided an advantage of reducing the amount of calculation in the conversion of the mass spectrum s' into the feature vector and an advantage of reducing a storage area.

In step S303, the detection rule learning module 206 detects whether a concentration value in a list of material containing a target sample at the time of measurement, which is related to each feature vector, is equal to or larger than, or smaller than a concentration threshold. In the case where the concentration value is equal to or larger than the concentration threshold, the detection rule learning module 206 provides the feature vector with a training signal (value of "+1"). In the other case, the detection rule learning module 206 provides the feature vector with another training signal (value of "−1"). In this way, the detection rule learning module 206 generates a feature vector set with training signal V.

In the next step S304, the detection rule learning module 206 learns a detection rule R(c, j) corresponding to the measurement action Mj for each material c on the basis of the feature vector set with training signal V. The detection rule R(c, j) may be, for example, a linear discriminant function, a piecewise linear discriminant function, a nonlinear discriminant function, a decision tree, or a neutral network such as a multilayer perceptron. It is recommended that the linear discriminant function and the nonlinear discriminant function be learned by a support vector machine of the typical learning method of them. It is recommended that the decision tree be learned by ID3 or C4.5 of the typical learning method thereof. It is recommended that the neutral network be learned by an error back propagation method of the typical learning method thereof.

Thereafter, in step S307, the detection rule learning module 206 adds 1 to j and performs the learning processing for the next measurement action.

[Prior Priority by Measurement Calculation Module 208]

A prior priority by measurement calculation module 208 calculates a prior priority by measurement P(c, j) by the use of the detection rule R(c, j) outputted from the detection learning module 206 and the mass spectrum s' of the mass spectrum database 212. The prior priority by measurement P(c, j) for the measurement action Mj may be the probability that, for example, a detection based on the mass spectrum s' obtained by the measurement action Mj is correct.

Figure 5:
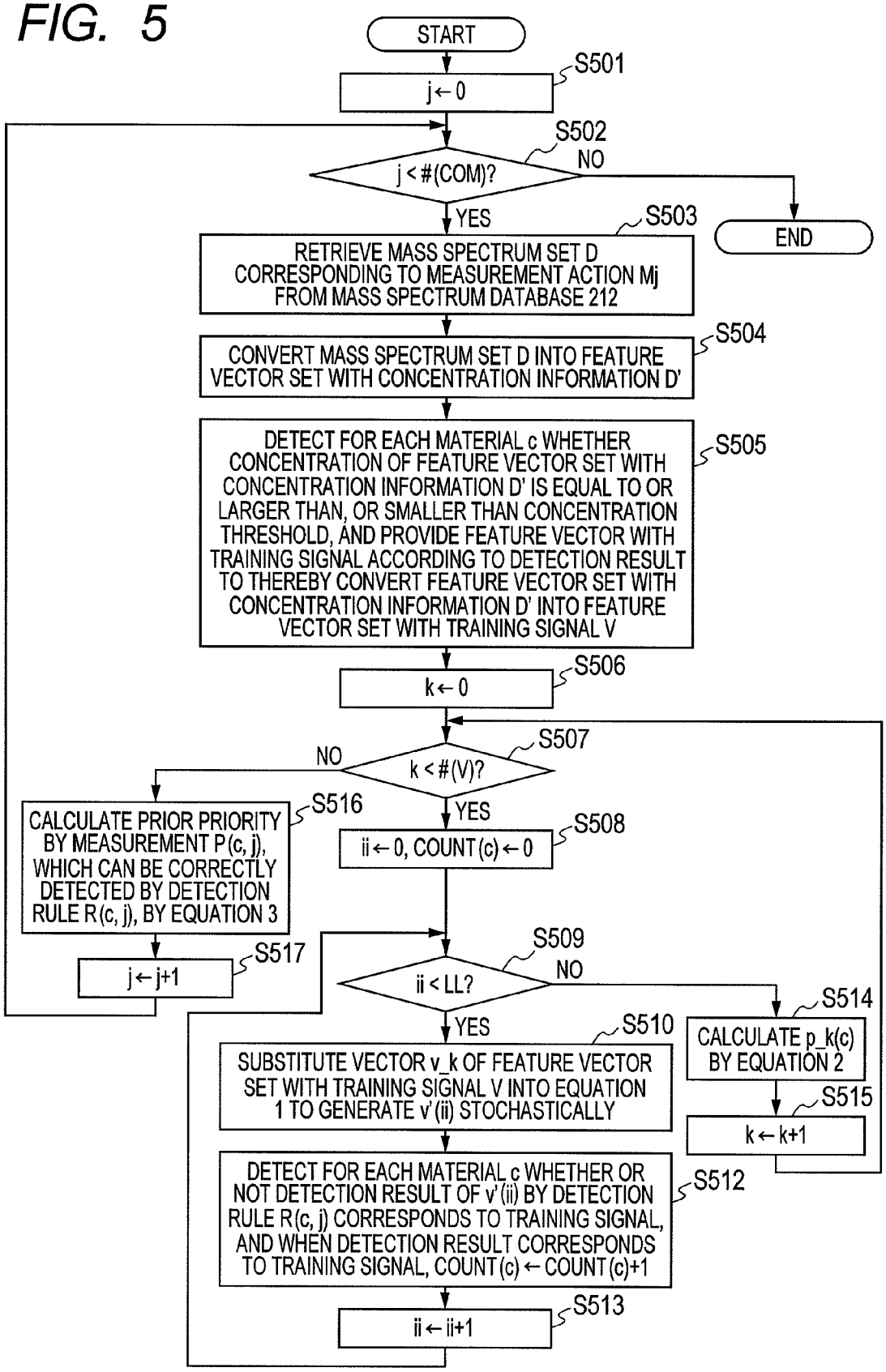
FIG. 5 is a flow chart to show a processing procedure performed by a prior priority by measurement calculation module.

FIG. 5 shows a processing procedure performed by the prior priority by measurement calculation module 208. Steps S501, S502, S503, S504, and S505 are the same as the steps S305, S306, S301, S302, and S303 of the detection learning module 206, respectively. That is, the feature vector set with training signal V is generated for each measurement action Mj.

In the step S506 and the subsequent steps thereof, the processings are performed for each element v_k (k=0, . . . , L) of the feature vector set V. In the step S506, k of identifying the element is initialized to 0.

In step S507, the prior priority by measurement calculation module 208 detects whether or not k is smaller than the number of the elements of the feature vector set V. If an affirmative result is obtained, the prior priority by measurement calculation module 208 proceeds to step S508, whereas if a negative result is obtained, the prior priority by measurement calculation module 208 proceeds to step S516.

In step S508, the prior priority by measurement calculation module 208 initializes the generated sample number ii and the number of the correct solutions COUNT(c) of each material c to 0, respectively.

In step S509, the prior priority by measurement calculation module 208 detects whether or not the generated sample number ii is smaller than the number of repetitions LL. If the generated sample number ii is smaller than the number of repetitions LL, the prior priority by measurement calculation module 208 proceeds to step S510 where the element v_k of the feature vector set V is substituted into an equation 1 to thereby generate v'(ii) stochastically.

$$P(v'(ii) \mid \text{v_k}) = \frac{1}{\sqrt{(2\pi)^D |\Sigma|}} \exp\left\{-\frac{1}{2}(v'(ii) - \text{v_k})^T \Sigma^{-1} (v'(ii) - \text{v_k})\right\} \quad \text{[Equation 1]}$$

Here, D denotes the number of dimensions of the feature vector and Σ denotes a covariance matrix. Σ may be, for example, a given value or a value calculated previously from a plurality of measurements for the same target sample.

In step S512, the prior priority by measurement calculation module 208 detects for each material c whether or not the detection result of v'(ii) by the detection rule R(c, j) corresponds to the training signal. If the detection result of v'(ii) by the detection rule R(c, j) corresponds to the training signal, the prior priority by measurement calculation module 208 adds 1 to COUNT(c).

In step S513, the prior priority by measurement calculation module 208 adds 1 to the generated sample number ii. The prior priority by measurement calculation module 208 repeats the stochastic sample generation and the detection until the generated sample number ii reaches the number of repetitions LL.

Thereafter, when the generated sample number ii reaches the number of repetitions LL, the prior priority by measurement calculation module 208 proceeds to step S514 where p_k(c) is calculated on the basis of an equation 2.

$$\text{p_k}(c) = \frac{\text{COUNT}(c)}{LL} \quad \text{[Equation 2]}$$

In step S515, the prior priority by measurement calculation module 208 adds 1 to k and returns to step S507. In this way, the prior priority by measurement calculation module 208 repeats a loop including steps S507 to S515 for all of the elements of the feature vector set V. When a series of processings for all of the elements of the feature vector set V are ended, the prior priority by measurement calculation module 208 proceeds to step S516 where a prior priority by measurement. P(c, j) is calculated on the basis of an equation 3.

$$P(c, j) = \frac{1}{\#(V)} \sum_{k=1}^{\#(V)} \text{p_k}(c) \quad \text{[Equation 3]}$$

In step S517, the prior priority by measurement calculation module 208 adds 1 to j and then returns to step S502. When the prior priority by measurement P(c, j) is calculated for all of the measurement actions Mj, the prior priority by measurement calculation module 208 ends the processing.

The prior priority by measurement calculation module 208 stores the calculated prior priority by measurement P(c, j) in the prior priority by measurement database 213.

FIG. 6 shows the data structure of the prior priority by measurement database 213. The prior priority by measurement database 213 is constructed of j rows and c columns and has the prior priority by measurement P(c, j) stored at a combination position of the measurement action Mj and the material c_m (where m is 1, 2, . . . , M) of the object to be measured.

The processings up to this step can be ended before the measurement action is started and do not need to be performed during the measurement action. In the following, remaining embodiments will be described with an emphasis on the processing performed during the measurement action.

[Measuring time Input Module 202]

A measuring time T_C is inputted through a measuring time input module 202. The measuring time input module 202 corresponds to the user interface section 105.

[Action Planning Module 201]

An action planning module 201 provides a function of determining a measurement schedule in which the MS analysis and the $MS^n$ analysis (where n≥2) are combined to each other so as to complete the measurement action at the measuring time T_C. In this case, the action planning module 201 provides a function of successively updating the combination of measurement actions constructing the measurement schedule also during a processing action according to a progress in the measurement. In this regard, the action planning module 201 maximizes the ratio of the $MS^n$ analysis constructing the measurement schedule within a range not exceeding the measuring time T_C.

Figure 7:
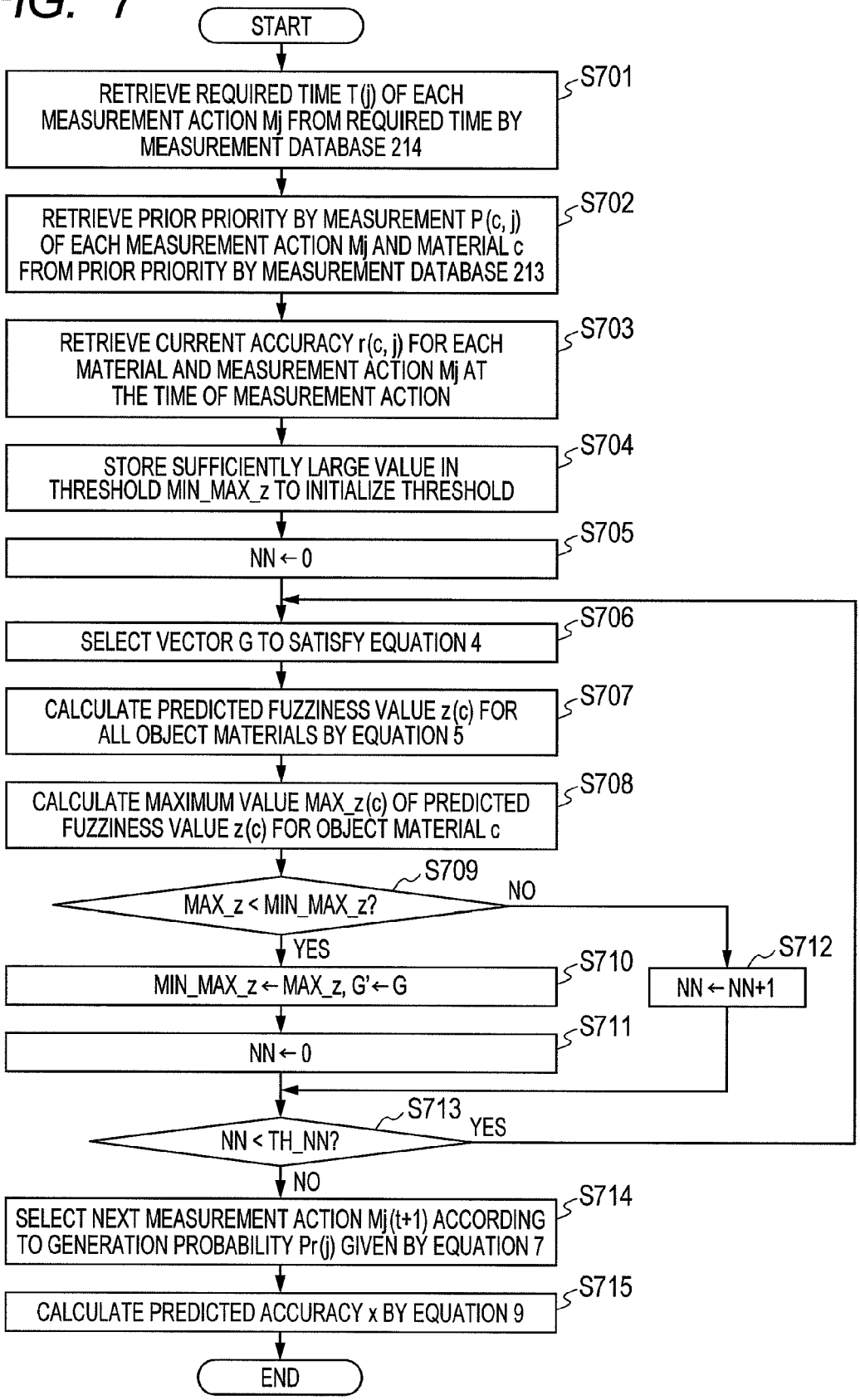
FIG. 7 is a flow chart to show a processing procedure performed by an action planning module.

FIG. 7 shows a processing procedure performed by the action planning module 201.

In step S701, the action planning module 201 retrieves a required time T(j) of each measurement action Mj from a required time by measurement database 214. FIG. 8 shows an example of a data structure of the required time by measurement database 214. A dissociation method in the $MS^n$ analysis includes a collision induced dissociation, an electron capture dissociation method, and the other dissociation methods. The required time by measurement T(j) is different also depending on these different dissociation methods. Further, the required time by measurement T(j) is different also depending on a set value of time of each of an accumulation process, an emission process, an isolation process, and a dissociation process of the ion. The required time by measurement database 214 has the required time by measurement T(j) registered automatically in advance depending on the setting of these analysis methods and on the time set for each process.

In step S702, the action, planning module 201 retrieves the prior priority by measurement P(c, j) of each measurement action Mj and material c from the prior priority by measurement database 213.

In step S703, the action planning module 201 retrieves a current accuracy r(c, j) for each material c and measurement action Mj at the time of each measurement action Mj. Here, at the time of a measurement start time t=0, a current accuracy r(c, j) outputted from the current accuracy calculation module 209 is initialized to a suitable value.

In step S704, the action planning module 201 stores a sufficiently large value in a threshold MIN_MAX_z (a minimum value required for a maximum value MAX_z of a predicted value z which will be described later) to initialize the threshold.

In step S705, the action planning module 201 initializes the number of times NN that the threshold MIN_MAX_z is not updated to 0.

In step S706, the action planning module 20 randomly selects the number of times g(j) of performing the measurement action Mj as a vector G=(g(1), . . . , g(#(COM))) to satisfy an equation 4.

$$\sum_{j=1}^{\#(COM)} T(j)g(j) = \mathrm{T_C} - t \qquad \text{[Equation 4]}$$

Here, t denotes time that elapses from when the measurement is started. Thus, when the measurement is started (t=0), the right-hand side of the equation 4 corresponds to the measuring time T_C. That is, the equation 4 means that the total sum of the processing times of the respective measurement actions Mj constructing the measurement schedule corresponds to the measuring time T_C.

In step S707, the action planning module 201 calculates a predicted fuzziness value z(c) when the measurement is completed for all object materials c by an equation 5.

$$z(c) = \sum_{j=1}^{\#(COM)} \left[H(r(c, j)) - \beta g(j) H\left(\gamma^t P(c, j) + (1-\gamma^t)\frac{r(c, j)}{t+1}\right)\right] \qquad \text{[Equation 5]}$$

where H(p)=−p log p−(1−p)log(1−p)

A first term in Σ on the right-hand side of the equation 5 represents fuzziness remaining in the measurements up to the current time and a second term in Σ represents the amount of information obtained by measurements in the future. The equation 5 is an equation for making all information of the measurement actions Mj included in the measurement action set COM be included in the predicted value.

In this regard, the predicted value z(c) is not always calculated by the equation 5 but may be calculated by an equation 6 or the like.

$$z(c) = \min_j \left[H(r(c, j)) - \beta g(j) H\left(\gamma^t P(c, j) + (1-\gamma^t)\frac{r(c, j)}{t+1}\right)\right] \qquad \text{[Equation 6]}$$

where H(p)=−p log p−(1−p)log(1−p)

Here, the equation 6 is an equation for using the smallest value of the values, which are calculated for the respective measurement actions Mj included in the measurement action set COM, as the predicted value.

In step S708, the action planning module 201 calculates' the maximum value MAX_z of the predicted fuzziness value z(c) for all object material's c.

In step S709, the action planning module 201 detects whether or not the maximum value MAX_z is smaller than the threshold MIN_MAX_z. If the maximum value MAX_z here is smaller than the threshold MIN_MAX_z (in the case of an affirmative result), the action planning module 201 proceeds to step S710.

In step S710, the action planning module 201 substitutes the value of the MAX_z into the threshold MIN_MAX_z and substitutes G into an optimal number of performances vector G' at the current time. Thereafter, in step S711, the action planning module 201 again initializes the number of times NN that the threshold MIN_MAX_z is not updated to 0.

On the other hand, if the maximum value MAX_z is equal to or larger than the threshold MIN_MAX_z (in the case of a negative result in step S709), the action planning module 201 adds 1 to the number of times NN in step S712.

In step S713, the action planning module 201 detects whether or not the number of times NN is smaller than a threshold TH_NN. If it is detected that the number of times NN is smaller than the threshold TH_NN (in the case of an affirmative result), the action planning module 201 returns to step S706. When the processings of steps S706 to S713 are repeatedly performed, the number of times of performances of minimizing the maximum value MAX_z of the individual predicted values z(c) can be found for all of the materials c.

A set of this number of times of performances constructs a number of times of performances vector G'(g'(1), . . . , g'(#(COM))). This means that a combination of the number of times of performances of the measurement action Mj for measuring all of the materials c at the highest degree of reliability can be found.

Here, a full search method is shown as an example of an optimization method, but a steepest descent method of a typical optimization method may be employed or a quasi-Newton method may be employed.

If a negative result is obtained in the detection processing of step S713, the action planning module 201 proceeds to step S714. In step S714, it is only necessary that the action planning module 201 selects the measurement action Mj of maximizing a generation probability Pr(j) given by an equation 7 as the next measurement action Mj(t+1). This processing corresponds to an action for determining performance sequence within the combination of the determined measurement actions Mj. That is, this processing corresponds to a determined action of the measurement schedule.

$$Pr(j) = \frac{g'(j)}{\sum_{j=1}^{\#(COM)} g'(j)} \quad \text{[Equation 7]}$$

In this regard, a method for randomly selecting a measurement action Mj(i+1) performed in the next step on the basis of the generation probability Pr(j) of the equation 7 may be applied.

Here, not only the next measurement action Mj(i+1) but also the measurement actions Mj(t+2) to Mj(t+$T_{com}$) of the next and subsequent times of measurement τ=t+2 to t+$T_{com}$ may be selected in the same way. However, in this case, as shown by an equation 8, it is also recommended that, in the selection at the time of the measurement τ, the generation probability Pr(τ, j) be found on the basis of the number of times obtained by subtracting the number of times SELECT_NUM(τ, j) that the measurement action Mj is selected up to the T from the optimum number of times of performances g'(j) and that the measurement action Mj of maximizing the generation probability Pr(τ, j).

$$Pr(\tau, j) = \frac{g'(j) - \text{SELECT_NUM}(\tau, j)}{\sum_{j=1}^{\#(COM)} \{g'(j) - \text{SELECT_NUM}(\tau, j)\}} \quad \text{[Equation 8]}$$

Further, the measurement action Mj may be selected at random according to the generation probability of Pr(τ, j). FIGS. 9A and 9B and FIGS. 10A and 10B show a difference between a measurement action series determined by performing the processing action described above and a measurement action series determined by a technique in the related art.

Figures 9A, 9B:
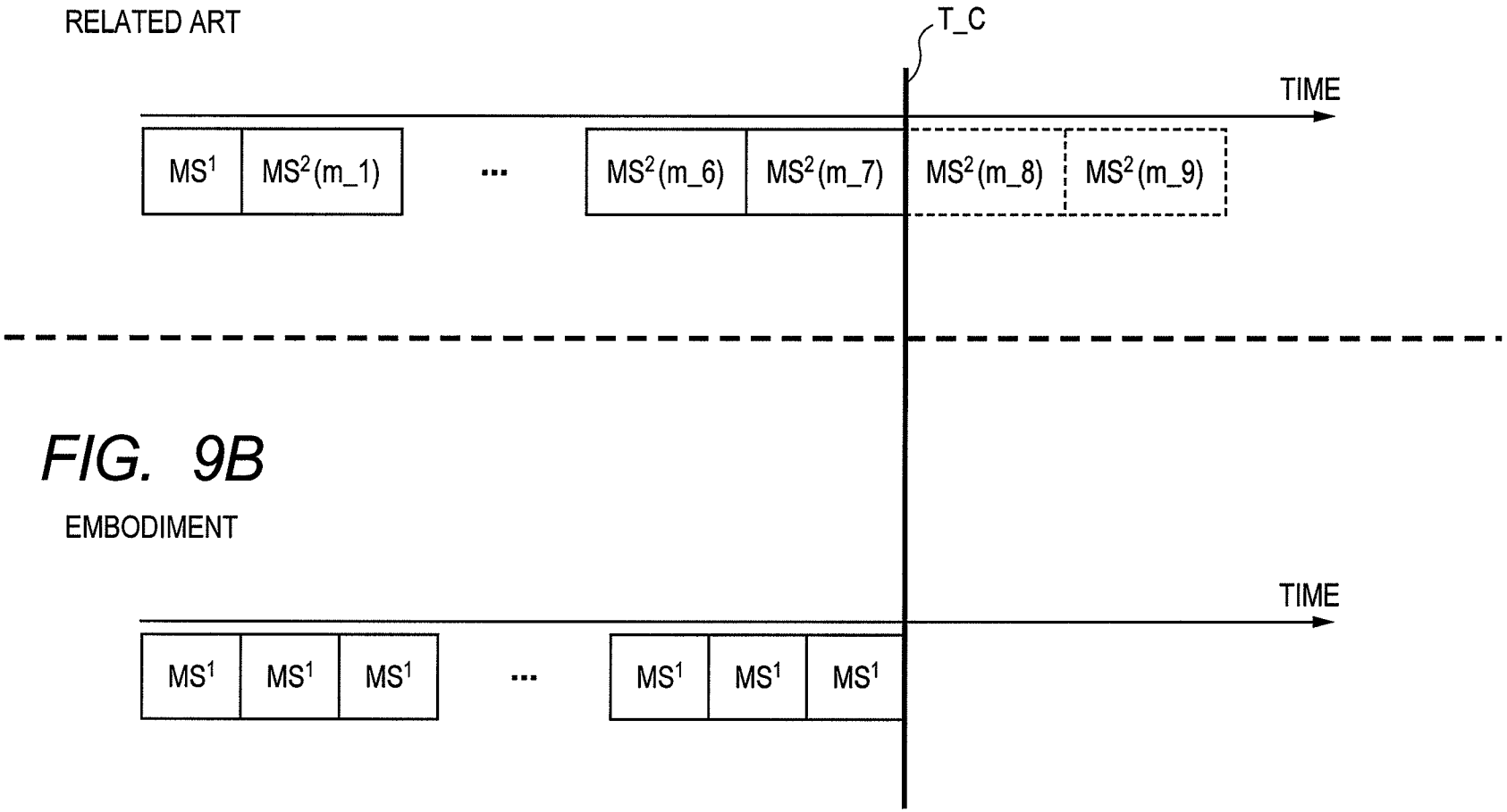
FIG. 9A RELATED ART
FIGS. 9A and 9B are views to show a measurement action series in a case where a measuring time is limited to a short time.

FIGS. 9A and 9B show examples of a measurement action series in the case where the measuring time T_C is limited to a comparatively short time. FIG. 9A shows a measurement action series (determined by the technique in the related art) in the case where the $MS^2$ analysis is performed for a material not yet to be detected without taking the limitation of the measuring time into account. In this case, since the measuring time T_C is not limited, even if time is required, the $MS^2$ analysis is performed for all materials. For this reason, the time required for the measurement of the materials will exceed the measuring time T_C.

FIG. 9B shows a measurement action series obtained in the case where the action planning module 201 selects the measurement action Mj in such a way that fuzziness is minimized for all materials to be measured under the condition that the measuring time T_C is limited (in the case of an example of this embodiment). In this case, since the measuring time T_C is short for the material to be measured, the action planning module 201 determines the measurement schedule in such a way that the frequency of the $MS^1$ analysis is increased. As a result, while the fuzziness is decreased impartially for all materials to be measured, all measurement actions can be finished within the measuring time T_C.

Figures 10A, 10B:
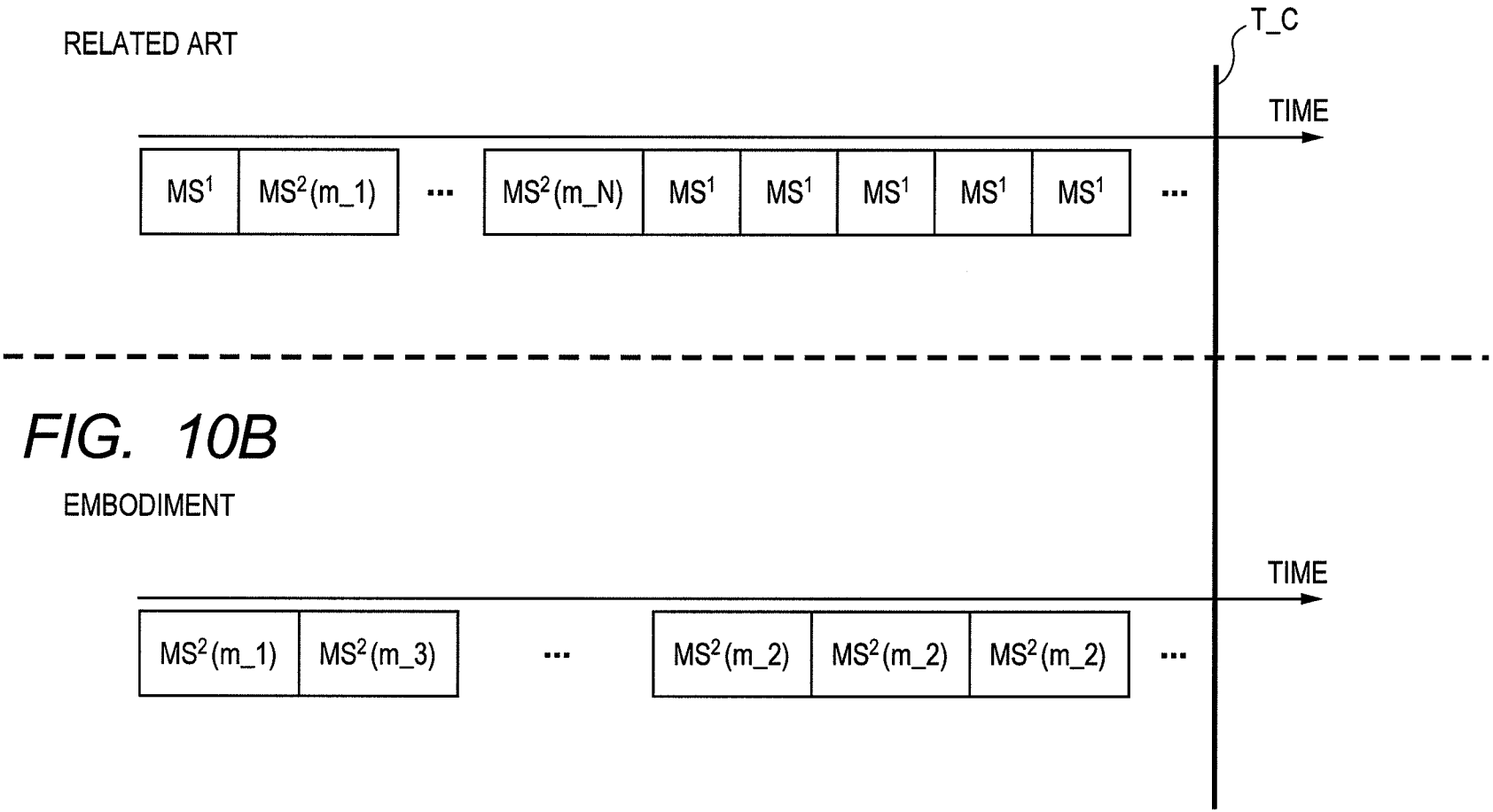
FIG. 10A RELATED ART
FIGS. 10A and 10B are views to show a measurement action series in a case where a measuring time is set to a sufficient length of time.

FIGS. 10A and 10B show examples of a measurement action series in the case where the measuring time T_C is set to a sufficiently long time. FIG. 10A shows a measurement action series (in the case of the technique in the related art) in the case where the $MS^2$ analysis is performed for a material not yet to be detected without taking the limitation of the measuring time into account. In this case, the $MS^2$ analysis is not performed for a material already identified, so that when all materials are detected once, even if the time remains sufficiently, the $MS^1$ analysis can be repeatedly performed.

As compared with the case of the $MS^2$ analysis, in the case of the $MS^1$ analysis, a certain amount of information can be obtained at the same time for all materials to be measured. However, even if the $MS^1$ analysis is repeatedly performed, the information of an amount equal to or more than a certain amount cannot be obtained and hence the fuzziness is likely to be not reduced.

FIG. 10B shows a measurement action series obtained in the case where the action planning module 201 selects the measurement action Mj in such a way that the fuzziness is minimized for all materials to be measured under the condition that the measurable time T_C is limited (in the case of an example of this embodiment). In the case where the measuring time T_C is sufficiently long, the $MS^2$ analysis that is longer in the required time by measurement T(j) and is higher in the prior priority by measurement P(c, j) than the $MS^1$ analysis can be preferentially selected. In this way, as long as the measurement time has leeway, the $MS^2$ analysis is performed in the case of the present embodiment, whereby the fuzziness is reduced.

In step S715, the action planning module 201 calculates a predicted accuracy x on the basis of an equation 9.

$$x = \begin{cases} 0 & \text{if } \max_c\{z(c)\} < 0 \\ 1 - \max_c\{z(c)\} & \text{if } 0 \le \max_c\{z(c)\} \le 1 \\ 1 & \text{if } \max_c\{z(c)\} > 1 \end{cases} \quad \text{[Equation 9]}$$

[Predicted Accuracy Presentation Module 211]

A predicted accuracy presentation module 211 is the user interface section 105 for presenting the predicted accuracy x outputted from the action planning module 201 to a user and is, for example, a display device.

[Measurement Action Presentation Module 216]

A measurement action presentation module 216 is the user interface section 105 for presenting the history of the measurement action Mj outputted from the action planning module 201 to the user and is, for example, a display device. The history includes the performed $MS^n$ analysis and the precursor ion selected by the $MS^n$ analysis.

[Mass Spectrometry Unit 100]

The mass spectrometry unit 100 performs the measurement action Mj to be scheduled after an elapsed time t according to the measurement schedule (measurement action series Mj(t+1) to Mj(t+$T_{com}$), where $T_{com}$ is a constant equal to or more than 1) outputted from the action planning module 201. Of course, the elapsed time t when the measurement is started is zero.

Figure 11:
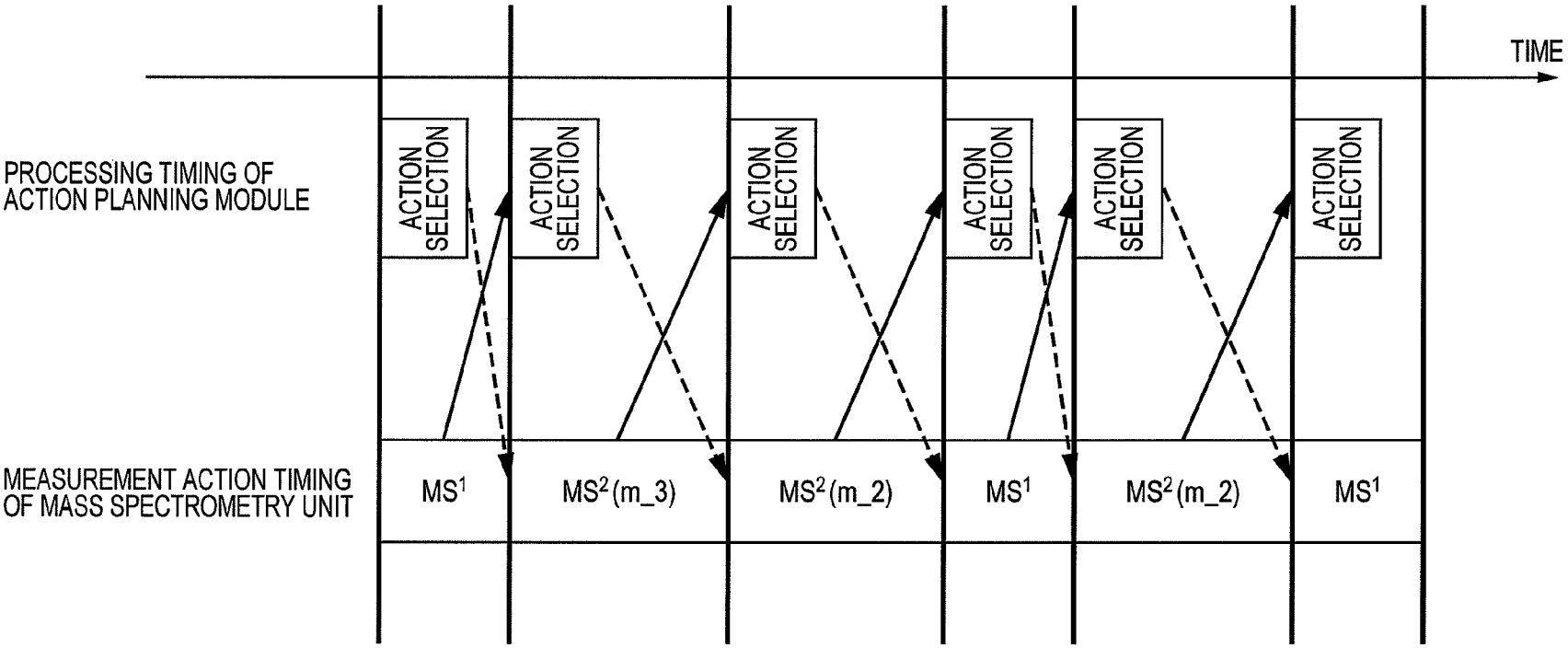
FIG. 11 is a view to show an example of performance timing of an action planning module and a mass spectrometry section in a case where $T_{com}=1$.
Figure 12:
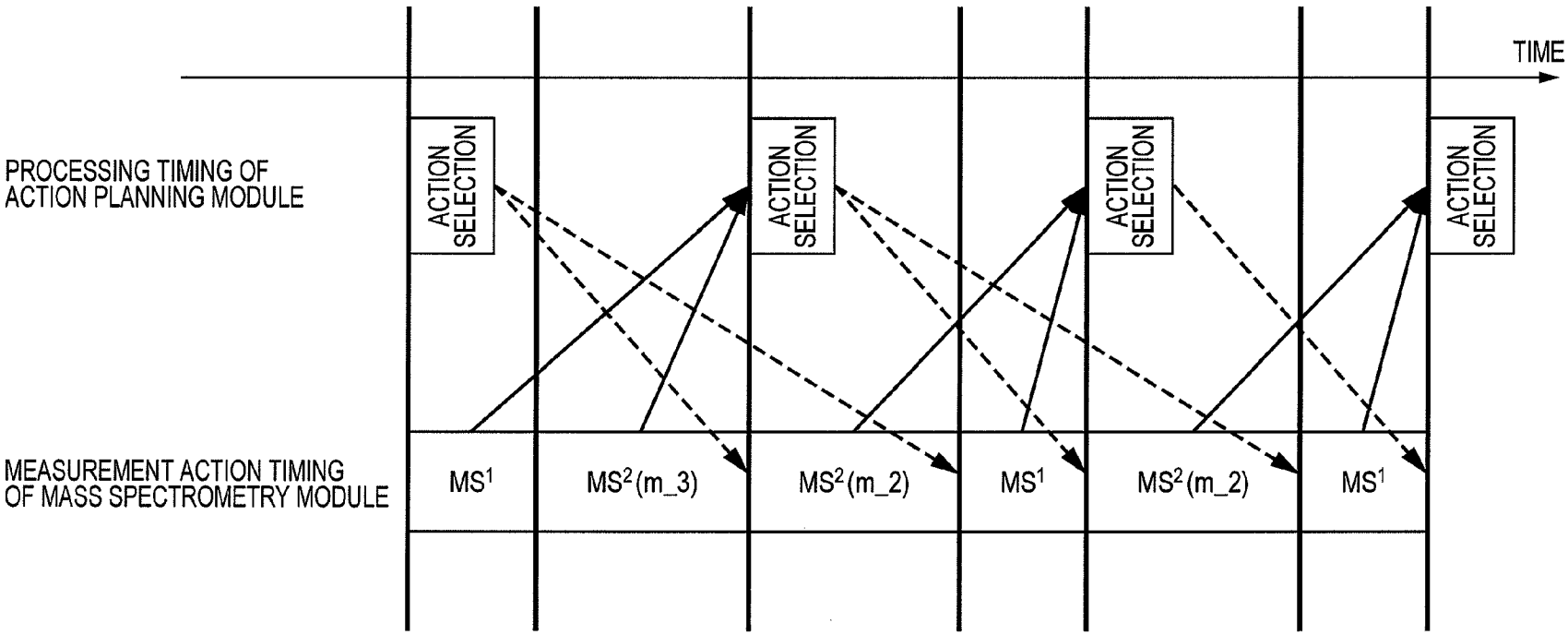
FIG. 12 is a view to show an example of performance timing of an action planning module and a mass spectrometry section in a case where $T_{com}=2$.

FIG. 11 and FIG. 12 show the relationship between a processing timing of the action planning module 201 and a measurement action timing of the mass spectrometry unit 100. In this regard, FIG. 11 is an example of an action in the case where $T_{com}$=1. This example shows a case where the action planning module 201 determines the content of the next measurement action every time the mass spectrometry unit 100 performs one measurement. FIG. 12 is an example of an action in the case where $T_{com}$=2. This example shows a case where the action planning module 201 determines the contents of the next two measurement actions every time the mass spectrometry unit 100 performs two measurements.

As in the latter case, in the case where the plurality of measurement actions are selected at the same time, there is provided an advantage of reducing the amount of calculation performed by the action planning module 201. Of course, by setting the value of Tcom to a large value, all measurement actions within the measurable time T_C can be also determined at the time when the measurement action is started. In this case, a measurement action planning within the measurement time is not required, which can preferably reduce a necessary computer resource. In addition, all measurement action series to be scheduled within a time remaining until the measuring time T_C can be given every time the mass spectrometry unit 100 performs one measurement or a plurality of measurements.

[Mass Spectrum Presentation Module 203]

A mass spectrum presentation module 203 corresponds to the user interface section 105 of presenting a mass spectrum outputted from the mass spectrometry unit 100.

[Detection Module 204]

A detection module 204 performs a detection of whether a material is present or absent on the basis of the mass spectrum outputted from the mass spectrometry unit 100 and of the detection rule R(c, j) outputted from the detection rule learning module 206. As described above, the detection rule R(c, j) may be the linear discriminant function, the piecewise linear discriminant function, the nonlinear discriminant function, the decision tree, or the neutral network such as the multilayer perceptron. The detection module 204 outputs a detection result A2 (value of "+1" or "−1") to the detection result presentation module 205.

[Detection Result Presentation Module 205]

The detection result presentation module 205 corresponds to the user interface section 105 of having the detection result A2 inputted thereto and of presenting the presence or absence of the material.

[Current Accuracy Calculation Module 209]

The current accuracy calculation module 209 calculates a current accuracy r(c, j) for each material c and measurement action Mj on the basis of the mass spectrum s and the detection rule R(c, j). Here, the current accuracy r(c, j) represents an index of the accuracy of the data measured by the elapsed time (that is, current time) t the current accuracy r(c, j) may be, for example, an estimated value of an accuracy rate in the case where the material c is detected on the basis of the spectrum obtained by the measurement action Mj.

Figure 13:
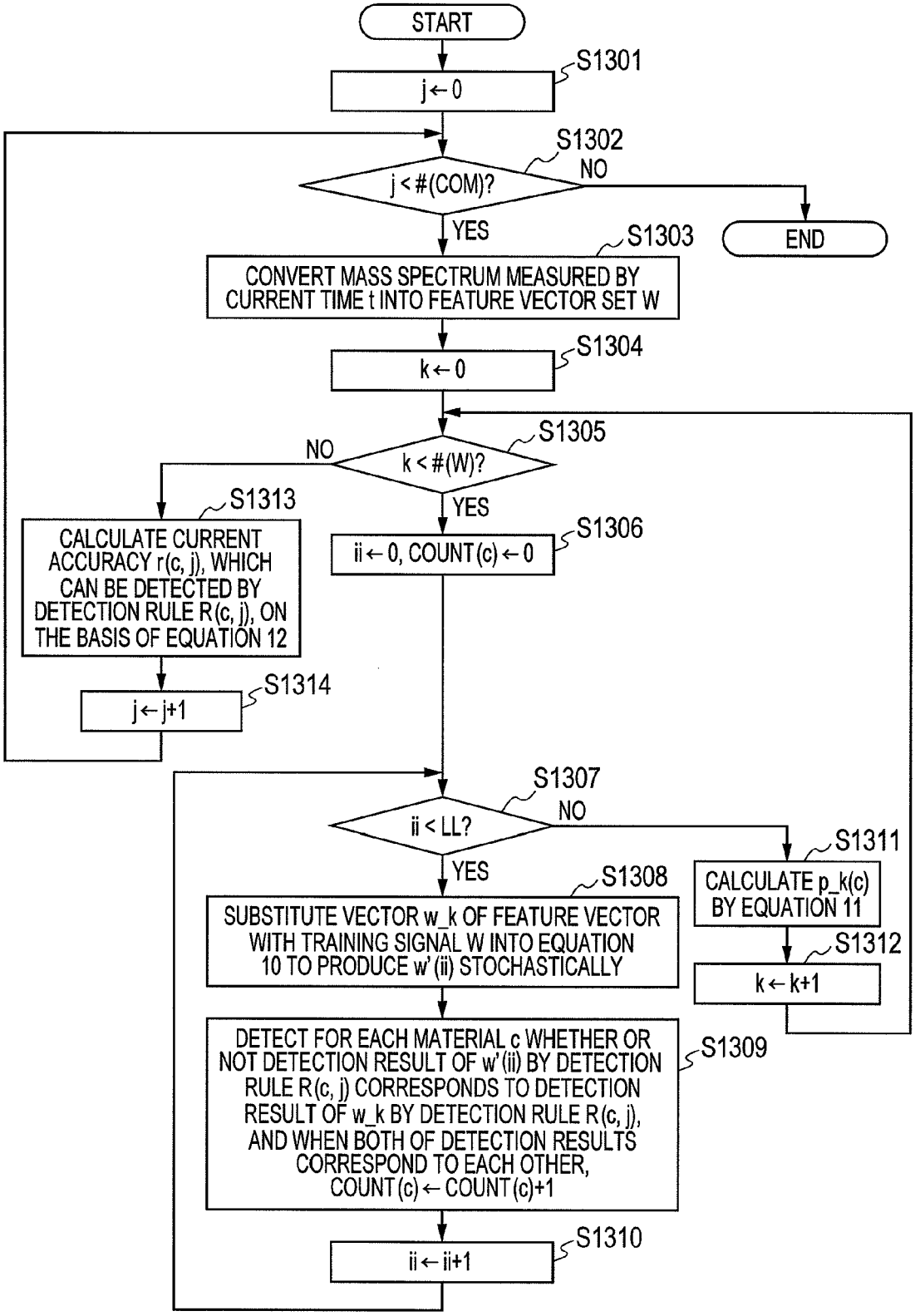
FIG. 13 is a flow chart to show a processing procedure performed by a current accuracy calculation module.

FIG. 13 shows an example of a processing procedure performed by the current accuracy calculation module 209 step S1301, the current accuracy calculation module 209 initializes j.

In step S1302, the current accuracy calculation module 209 detects whether or not j is smaller than the number of elements of the measurement action set COM. If an affirmative result is obtained, the current accuracy calculation module 209 performs processings of the step S1303 and subsequent steps. If j exceeds the number of elements of the measurement action set COM, the current accuracy calculation module 209 ends the processing.

In step S1303, the current accuracy calculation module 209 converts the mass spectrum measured by the measurement time t (that is, current time) into a feature vector set W. A method for converting the mass spectrum into the feature vector set W may be the same as the method described in the step S302 of the detection rule learning module 206.

In the step S1304 and subsequent steps, the current accuracy calculation module 209 performs processings for each element w_k (k=0, 1, . . . ,) of the feature vector set W.

In step S1304, the current accuracy calculation module 209 initializes k of identifying an element. In step S1305, the current accuracy calculation module 209 detects whether or not the element w_k is smaller than the number of elements of the feature vector set W. If an affirmative result is obtained, the current accuracy Calculation module 209 proceeds to step S1306 and if a negative result is obtained, the current accuracy calculation module 209 proceeds to step S1313.

In step S1306, the current accuracy calculation module 209 initializes a generated sample number ii and the number of correct solutions COUNT(c) for each material c.

In step S1307, the current accuracy calculation module 209 detects whether or not the generated sample number ii is smaller than the number of repetitions LL. If the generated sample number ii is smaller than the number of repetitions LL, the current accuracy calculation module 209 proceeds to step S1308, whereas if the generated sample number ii is equal to or larger than the number of repetitions LL, the current accuracy calculation module 209 proceeds to step S1311.

In step S1308, the current accuracy calculation module 209 substitutes the element w_k of the feature vector set W into an equation 10 to thereby generate w'(ii) stochastically.

$$P(w'(ii) \mid \mathrm{w_k}) = \frac{1}{\sqrt{(2\pi)^D |\Sigma|}} \exp\left\{-\frac{1}{2}(w'(ii) - \mathrm{w_k})^T \Sigma^{-1} (w'(ii) - \mathrm{w_k})\right\} \quad \text{[Equation 10]}$$

Here, D denotes the number of dimensions of the feature vector and Σ denotes a covariance matrix. Σ is, for example, a given parameter. However, Σ may be calculated in advance for a plurality of numbers of measurements for the same target sample.

In step S1309, the current accuracy calculation module 209 detects for each material c whether or not a result obtained by detecting w'(ii) by the detection rule R(c, j) corresponds to a result obtained by detecting w_k by the detection rule R(c, j). If both of the results correspond to each other, the current accuracy calculation module 209 adds 1 to the number of correct solutions COUNT(c).

In step S1310, the current accuracy calculation module 209 adds 1 to the generated sample number ii. The current accuracy calculation module 209 repeats the stochastic generation and detection of the sample until the generated sample number ii reaches the number of repetitions LL.

When the generated sample number ii reaches the number of repetitions LL (an affirmative result is obtained in step S1307), the current accuracy calculation module 209 proceeds to step S1311.

In step S1311, the current accuracy calculation module 209 calculates b_k(c) on the basis of an equation 11.

$$\text{b_k}(c) = \frac{\text{COUNT}(c)}{LL} \quad \text{[Equation 11]}$$

In step S1312, the current accuracy calculation module 209 adds 1 to k and returns to step S1305. A loop processing including these steps S1305 to S1312 is repeatedly performed for all of the elements w_k of the feature vector set W.

When the loop processing including the steps S1305 to S1312 is finished for all of the elements w_k of the feature vector set W (a negative result is obtained in step S1305), the current accuracy calculation module 209 proceeds to step S1313.

In step S1313, the current accuracy calculation module 209 calculates the current accuracy r(c, j) on the basis of an equation 12.

$$r(c, j) = \frac{1}{\#(W)} \sum_{k=1}^{\#(W)} \text{b_k}(c) \quad \text{[Equation 12]}$$

In step S1314, the current accuracy calculation module 209 adds 1 to j and returns to step S1302. When the current accuracy r(c, j) is calculated for all measurement actions Mj, the current accuracy calculation module 209 ends the processing.

As described above, the current accuracy r(c, j) calculated by the current accuracy calculation module 209 is used for selecting the measurement action Mj in the action planning module 201. Further, the current accuracy r(c, j) is presented to the user through the current time presentation module 210.

[Current Time Presentation Module 210]

The current time presentation module 210 corresponds to the user interface section 105.

[Required Accuracy Input Module 217]

The required accuracy input module 217 corresponds to the user interface section 105.

[Recommended Measurement Time Calculation Module 215]

The recommended measurement time calculation module 215 is performed in the case where the user inputs a required accuracy y through the required accuracy input module 217 and calculates a recommended measurement time T_H necessary for satisfying the required accuracy y.

Figure 16:
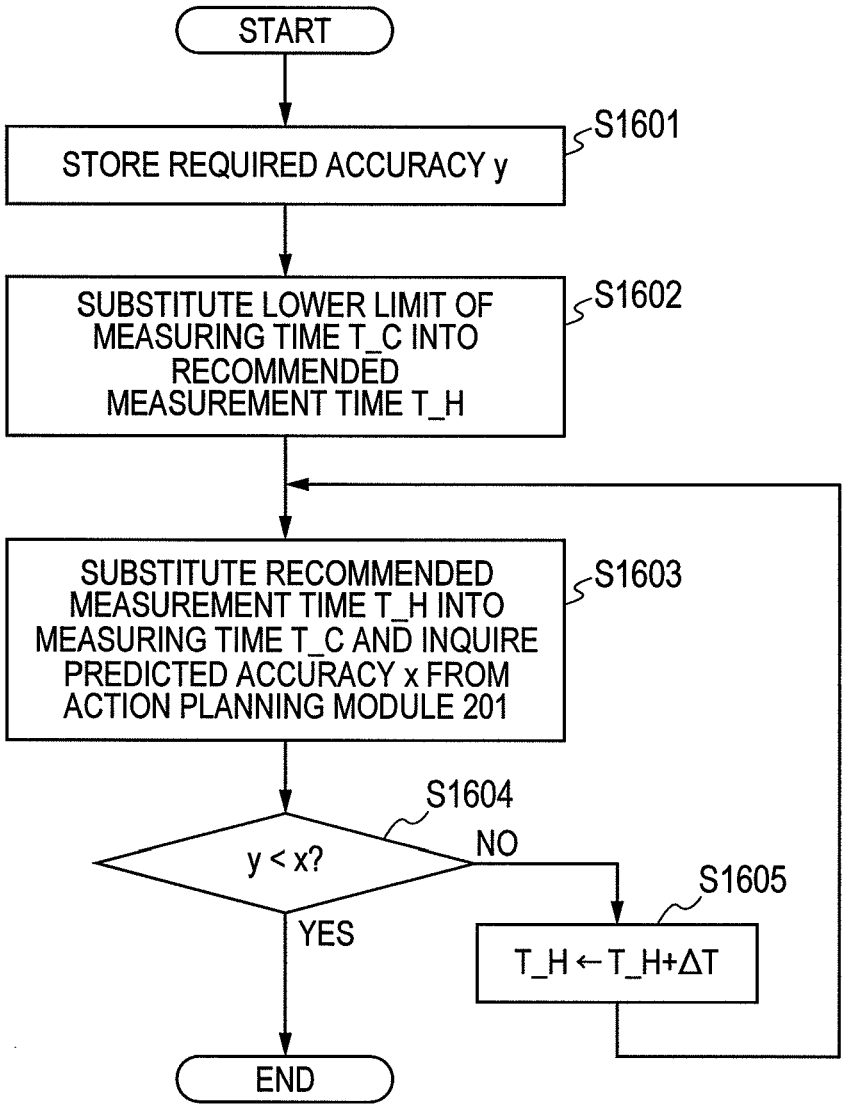
FIG. 16 is a flow chart to show a processing procedure performed by a recommended time calculation module.

FIG. 16 shows an example of a processing procedure performed by the recommended measurement time calculation module 215.

In step S1601, the recommended measurement time calculation module 215 stores the value of the inputted required accuracy y in a storage area (not shown).

In step S1602, the recommended measurement time calculation module 215 substitutes a suitable lower limit value of the measuring time T_C into the recommended measurement time T_H so as to initialize the recommended measurement time T_H.

In step S1603, the recommended measurement time calculation module 215 substitutes the recommended measurement time T_H into the measuring time T_C and inquires the predicted accuracy x from the action planning module 210. When the action planning module 201 receives the inquiry, the action planning module 201 performs the processing for the changed measuring time T_C (=T_H) to calculate the predicted accuracy x.

In step S1604, the recommended measurement time calculation module 215 compares the predicted accuracy x with the required accuracy y. If the predicted accuracy x is larger than the required accuracy y, the recommended measurement time calculation module 215 ends the processing without performing any processing. On the other hand, if the predicted accuracy x is equal to or smaller than the required accuracy y, the recommended measurement time calculation module 215 proceeds to step S1605.

In step S1605, the recommended measurement time calculation module 215 adds a small amount ΔT to the recommended measurement time T_H and returns to step S1603.

The recommended measurement time calculation module 215 presents the recommended measurement time T_H calculated in this way to the measuring time input module 202 and at the same time limits an input value to within a range equal to or more than T_H−λ and equal to or smaller than T_H+λ. Further, the recommended measurement time calculation module 215 automatically substitutes the recommended measurement time T_H into the measuring time T_C and provides the action planning module 201 with a time value after substitution as a candidate measuring time A3. When this function is used, the measuring time necessary for realizing the required accuracy can be automatically inputted, so that an operation required of the user can be made simple.

[User Interface Section 105]

Figure 15:
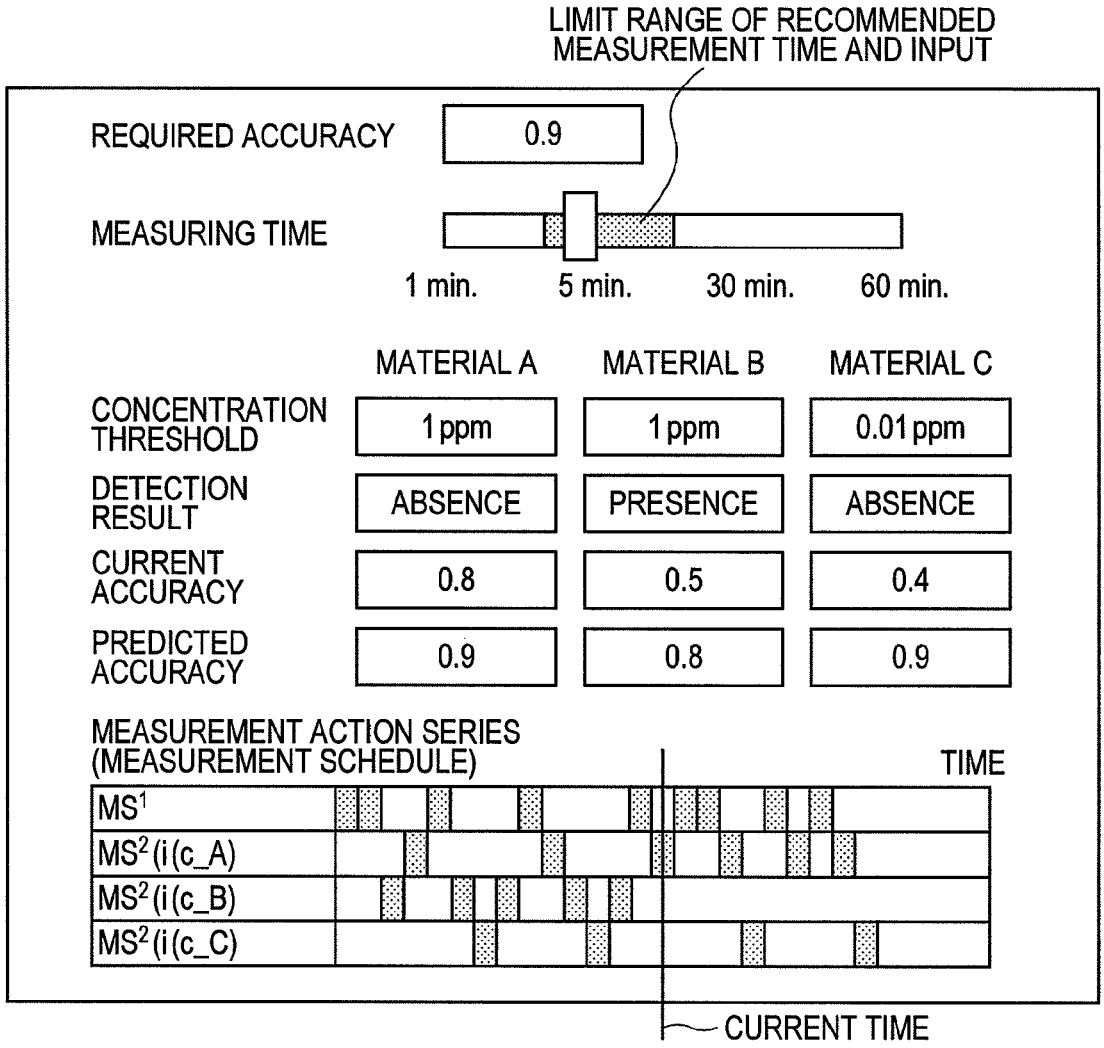
FIG. 15 is a view to show an example of a screen construction of a user interface module.

FIG. 15 shows an example of a presentation screen of the user interface section 105. In the presentation screen of the user interface section 105, as described above, are arranged the areas corresponding to the measuring time input module 202, the detection result presentation module 205, the concentration threshold input module 20, the current accuracy presentation module 210, the predicted accuracy presentation module 211, the measurement action presentation module 216, and the required accuracy input module 217.

The display contents constructing the presentation screen shown in FIG. 15 include "required accuracy", "measuring time", "concentration threshold", "detection result", "current accuracy", "predicted accuracy", and "measurement action series" in order from the top.

In the case of this example, as for the measuring time T_H, a value of the measuring time can be inputted by setting the position of a sliding bar within a time range to be inputted (from 1 minute to 60 minutes). In this way, the user can tune the measuring time only by moving the sliding bar. A limit range to be inputted is shown in the sliding bar by a shaded region, so that the user cannot input a time outside the limit range shown by the shaded region. For this reason, the user can easily adjust the measuring time T_C within a suitable range.

Further, in a display table of "measurement action series", the contents of the MS analysis and the MS analysis constructing the measurement action series (measurement schedule) and the timings when the MS analysis and the MS analysis are performed are displayed in correspondence with each other. For this reason, the user can easily check how the respective analyses are performed on the screen.

[Identification Module 218]

The identification module 218 identifies the material c on the basis of the mass spectrum s outputted from the mass spectrometry unit 100 and the mass spectrum vector s' stored in the mass spectrum database. The identification module 218 converts the mass spectrums s and s' into a feature vectors $\phi$ and $\phi'$, as in the case of step S302 of the detection rule learning module 206, and outputs the name of a contained material, which has a maximum concentration corresponding to $\phi'$ in which the cosine similarity between the feature vectors becomes maximum, as an identification result A4.

[Identification Result Presentation Module 219]

The identification result presentation module 219 presents the identification result A4 to the user through the user interface section 105.

[Quantification Module 220]

The quantification module 220 quantifies the material c on the basis of the mass spectrum s outputted from the mass spectrometry unit 100 and the mass spectrum s' stored in the mass spectrum database. The quantification module 220 converts the mass spectrums s and s' into the feature vectors $\phi$ and $\phi'$, as in the case of step S302 of the detection rule learning module 206, and finds $\phi'$ in which the cosine similarity between the feature vectors becomes maximum. Next, the quantification module 220 calculates an estimated concentration d ($=d'\times|\phi|/|\phi'|$) by the use of a concentration d' of a contained material having a maximum concentration corresponding to the $\phi'$. The quantification module 220 outputs the name and the estimated concentration d of the contained material, which has the maximum concentration, as a quantification result A5 to the quantification result presentation module 221.

[Quantification Result Presentation Module 221]

The quantification result presentation module 221 presents the quantification result A5 to the user through the user interface section 105.

Second Embodiment

System Construction

The construction shown in FIG. 2 is suitable for the case where there is no temporal limitation for the supply of electric power to the mass spectrometry unit 100, the central processing unit 104, and the volatile memory 110 that construct the mass spectrometry system. However, in the case where an electric power supply time of supplying electric power to the mass spectrometry unit 100 and the like is limited, the maximum value of the measuring time T_C by the mass spectrometry system is limited by the electric power supply time.

Figure 17:
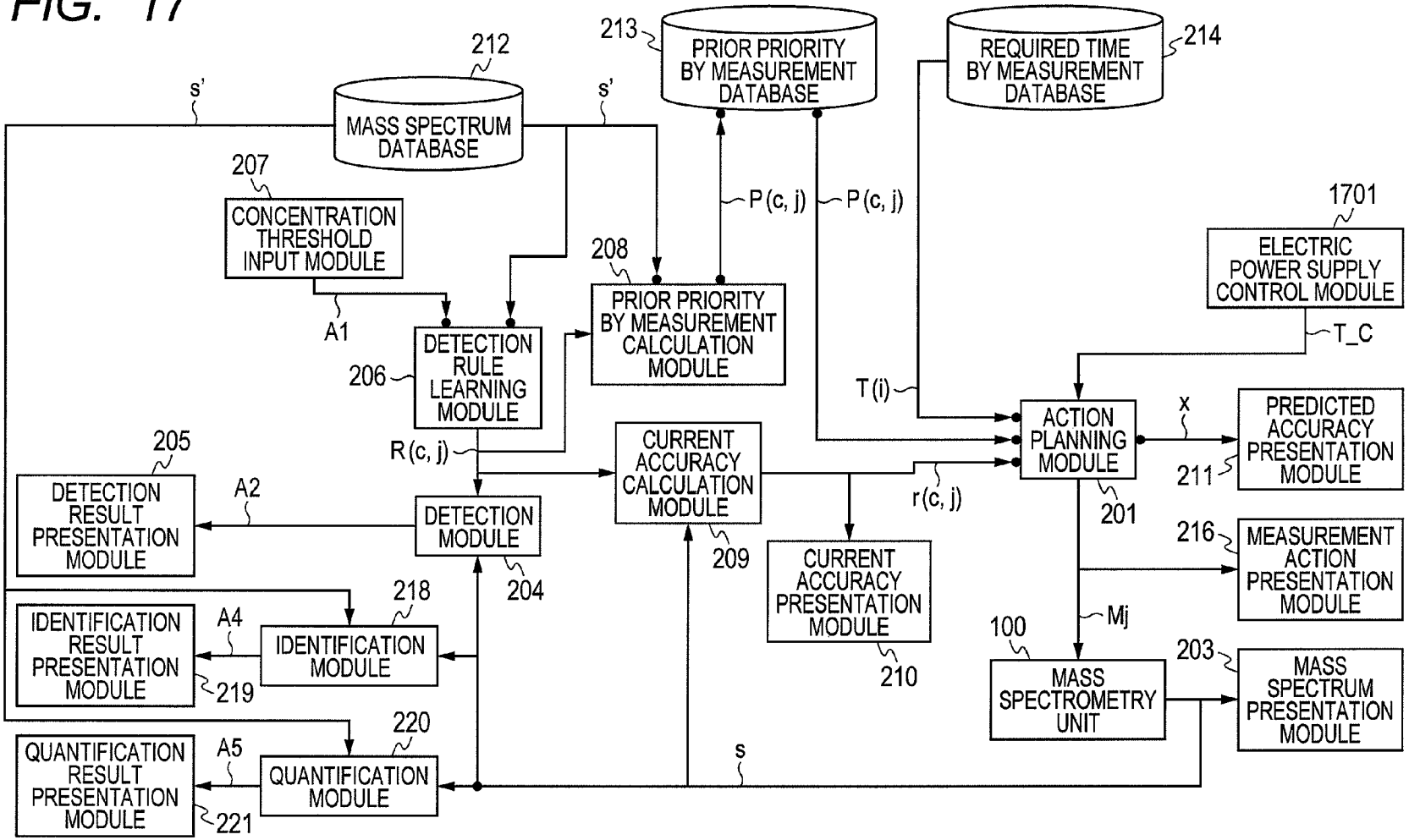
FIG. 17 is a view to show a function block diagram of a mass spectrometry system according to another embodiment.

In this case, amass spectrometry system having a hardware construction shown in FIG. 17 can be desirably employed. In FIG. 17, the modules, the unit, and the like corresponding to those in FIG. 2 are denoted by the same reference symbols. The system shown in FIG. 17 is different from the system shown in FIG. 2 in the following two points: that is, the measuring time input module 202, the recommended measurement time calculation module 215, and the required accuracy input module 217 are removed from the system shown in FIG. 2 and an electric power supply control module 1701 is newly added to the system. However, it is also recommended that the electric power supply control module 1701 is simply added to the system shown in FIG. 2.

The electric power supply control module 1701 is a function module for successively monitoring the remaining time of the electric power supply time. This function is also realized through a program executed on the central processing unit 104. The electric power supply control module 1701 outputs a remaining time in which the electric power can be supplied as a measuring time. Since the system shown in FIG. 17 is mounted with this function, the system can prevent the measurement from being stopped in midstream when the electric power supply is stopped.

[Summarization]

As described above, in the mass spectrometry system according to the embodiment, the action planning module 201 is implemented with the function of determining or successively updating the measurement action series (measurement schedule) provided by the combination of the MS analysis and the $MS^n$ analysis (where $n\geq2$).

In the case where the measuring time T_C is limited to a short time, this action planning module 201 determines the measurement schedule in which the frequency of the MS analysis is increased. For this reason, the action planning module 201 can finish the detection of the presence or absence of all object materials, the identification or the quantification of all object materials within the measuring time T_C. Further, in the case where the measuring time T_C is set to a sufficient long time, the action planning module 201 determines the measurement schedule in such a way as to increase the frequency of the $MS^n$ analysis (where $n\geq2$). For this reason, the accuracy of detection of the presence or absence of the object material, the accuracy of identification of the kind of the object material, or the accuracy of quantification of the object material for each kind can be increased according to the length of the measuring time T_C.

As a result, the mass spectrometry system can realize the detection of the presence or absence, the identification, or the quantification of all materials of the objects to be measured within the measuring time T_C and with as high a degree of accuracy as possible.

In this regard, it is assumed that the measurement schedule includes the mass-to-charge ratio of the precursor ion in the $MS^n$ analysis. For this reason, the measurement schedule taking into account the time required to perform each measurement action Mj and the predicted accuracy x can be determined.

Further, the action planning module 201 selects the measurement action series (measurement schedule) successively on the basis of the required time by measurement T(i), the prior priority by measurement P(c, j), and the current accuracy r(c, j), so that the action planning module 201 can reliably finish all measurement actions within the measuring time T_C.

Still further, the action planning module 201 changes the required time by measurement T(i) on the basis of the set values of the method for dissociating an ion in the mass spectrometry unit 100, or the respective set values of the respective times for the accumulation process, the emission process, the isolation process, and the dissociation process in, the mass spectrometry unit 100. For this reason, the action planning module 201 can increase the accuracy of selection of the measurement action series constructing the measurement schedule.

Still further, even in the case where the electric power supply time for the external computer or the mass spectrometry device is limited, the action planning module 201 can change the measuring time T_C according to the remaining time of the electric power supply time and hence can finish all measurements by the time when the electric power supply is finished.

Other Embodiments

In this regard, the present invention is not limited to the embodiments described above but can include various modifications thereof. For example, the embodiments described above have been described in detail so as to describe the present invention in an easily understood manner, but the present invention is not always limited to a mass spectrometry system including the entire construction described above. Further, a portion of the embodiment can be substituted for the construction of the other embodiment. Still further, the construction of an embodiment can also have the construction of the other embodiment added thereto. Still further, a portion of the construction of each embodiment can also have the other construction added thereto, removed therefrom, or substituted therefor.

In addition, a portion of or all of the respective constructions, functions, processing modules, and processing means may be realized as, for example, an integrated circuit or the other hardware. Further, the respective constructions and functions may be realized by processors interpreting and executing programs for realizing the respective functions, that is, may be realized as software. The information of the programs, the tables, and the files for realizing the respective functions can be stored in a storage device such as a memory, a hard disc, and an SSD (Solid State Drive), or a storage medium such as an IC card, an SD card, and a DVD.

In further addition, as for the control lines and the information lines, those necessary for the description of the invention are shown, and all of control lines and the information lines necessary for the product are not always shown. In reality, almost all constructions can be considered to be connected to each other.

What is claimed is:

1. A mass spectrometry system comprising:

an action planning module for determining a measurement schedule that includes a combination of measurement actions of an MS analysis and an $MS^n$ analysis (where $n \geq 2$) at respective frequencies set by the action planning module according to a previously provided measuring time; and a mass spectrometry unit having a tandem mass spectrometry function for outputting a mass spectrum obtained by performing each of the measurement actions of the MS analysis and $MS^n$ analysis forming the measurement schedule.

2. The mass spectrometry system according to claim 1, wherein the action planning module successively updates the combination of the measurement actions forming the measurement schedule even after a mass spectrum based on one or more of the measurement actions is obtained.

3. The mass spectrometry system according to claim 2, wherein the measurement schedule includes a measurement action of measuring a mass-to-charge ratio of a precursor ion by the $MS^n$ analysis.

4. The mass spectrometry system according to claim 2, wherein the action planning module updates the measurement schedule in such a way that a measurement according to the updated measurement schedule is finished within the measureable time from when the measurement is started.

5. The mass spectrometry system according to claim 1, wherein in the case where the measuring time is reduced, the action planning module determines or updates the measurement schedule in such a way that while the frequency of the $MS^n$ analysis appearing in the measurement schedule is relatively decreased, the frequency of the MS analysis is relatively increased.

6. The mass spectrometry system according to claim 1, wherein the action planning module determines or updates the measurement schedule on the basis of a required time for each measurement action and a prior priority of each measurement action.

7. The mass spectrometry system according to claim 6, wherein the action planning module changes the required time for each measurement action on the basis of set values of an ion isolation method or set values of the respective required times corresponding to an accumulation process, an emission process, an isolation process, and a dissociation process in the mass spectrometry unit, and further determines or updates the measurement actions forming the measurement schedule on the basis of the required time for each measurement action.

8. The mass spectrometry system according to claim 6, comprising:

a required time database for storing the required time for each measurement action; and a prior priority database for storing a prior priority of each measurement action.

9. The mass spectrometry system according to claim 6, comprising:

a mass spectrum database for storing a set of a measurement action, a content by a material, and a mass spectrum; and a prior priority calculation module for calculating the prior priority of each measurement action on the basis of the mass spectrum database.

10. The mass spectrometry system according to claim 9, comprising:

a content threshold input module for inputting a content threshold by the material;

a detection rule learning module for learning a detection rule on the basis of the data of the mass spectrum database and the content threshold;

a detection module for detecting presence or absence of a material on the basis of the mass spectrum outputted by the mass spectrometry unit and the detection rule and for outputting a detection result; and a detection result presentation module for presenting the detection result.

11. The mass spectrometry system according to claim 9, wherein the mass spectrum database includes data of a feature vector converted on the basis of the mass spectrum.

12. The mass spectrometry system according to claim 6, wherein the prior priority of each measurement action is an estimated value of an accuracy rate for the material to be detected on the basis of the mass spectrum obtained by the respective measurement action.

13. The mass spectrometry system according to claim 1, comprising:

a current accuracy calculation module for calculating a current accuracy on the basis of the mass spectrum outputted by the mass spectrometry unit, wherein the action planning module successively determines or updates the measurement schedule according to the current accuracy.

14. The mass spectrometry system according to claim 1, comprising:

a measuring time input module for inputting the measuring time by a user; and a recommended measurement time calculation module for calculating recommended measurement time according to a predicted accuracy calculated by the action planning module, wherein the measuring time input module limits a range of a value inputted to the measuring time input module according to the recommended measurement time.

15. The mass spectrometry system according to claim 1, wherein the action planning module calculates a predicted accuracy, and comprising:

a recommended measurement time calculation module that calculates a recommended measurement time according to the predicted accuracy.

16. The mass spectrometry system according to claim 1, comprising:

a power supply control module for successively monitoring a remaining time of power supply, wherein the action planning module changes the measureable time according to the remaining time and determines or successively updates the measurement schedule based on the changed measurable time.

17. The mass spectrometry system according to claim 1, comprising:

an identification module for identifying a kind of a material according to the mass spectrum outputted by the mass spectrometry unit and for outputting a result of the identification; and an identification result presentation module for presenting the result of the identification to a user.

18. The mass spectrometry system according to claim 1, comprising:

a quantification module for quantifying a content of a material according to the mass spectrum outputted by the mass spectrometry unit and for outputting a result of the quantification; and a quantification result presentation module for presenting the result of the quantification to a user.

19. The mass spectrometry system according to claim 1, comprising:

a measurement action presentation module for presenting a series of measurement actions of the measurement schedule already performed or a series of measurement actions of the measurement schedule scheduled to be performed.

20. A computer readable medium storing a program causing a computer to execute a process for mass spectrometry, the process comprising:

determining a measurement schedule that includes a combination of measurement actions of an MS analysis and an $MS^n$ analysis (where $n \geq 2$) at respective frequencies set according to a previously provided measuring time; and outputting a mass spectrum obtained by performing each of the measurement actions of the MS analysis and $MS^n$ analysis forming the measurement schedule.

* * * * *